US009437084B2

(12) United States Patent
Rodgers et al.

(10) Patent No.: US 9,437,084 B2
(45) **Date of Patent: *Sep. 6, 2016**

(54) GAMING SYSTEM AND METHOD FOR PROVIDING A CASCADING SYMBOL GAME INCLUDING A PLURALITY OF INDEPENDENT REELS WHICH PROVIDE A STACKED SYMBOL FUNCTIONALITY

(71) Applicant: IGT, Las Vegas, NV (US)

(72) Inventors: Paulina Rodgers, Reno, NV (US); Christmas C. Parker, Reno, NV (US); Benjamin C. Hoffman, Reno, NV (US)

(73) Assignee: IGT, Las Vegas, NV (US)

( * ) Notice: Subject to any disclaimer, the term of this patent is extended or adjusted under 35 U.S.C. 154(b) by 167 days.

This patent is subject to a terminal disclaimer.

(21) Appl. No.: 14/070,097

(22) Filed: Nov. 1, 2013

(65) Prior Publication Data

US 2014/0057698 A1 Feb. 27, 2014

Related U.S. Application Data

(63) Continuation of application No. 12/271,504, filed on Nov. 14, 2008, now Pat. No. 8,574,059.

(51) Int. Cl.
*G07F 17/34* (2006.01)
*G07F 17/32* (2006.01)

(52) U.S. Cl.
CPC ..... *G07F 17/34* (2013.01); *G07F 17/3265* (2013.01)

(58) Field of Classification Search
CPC .. G07F 17/326; G07F 17/3267; G07F 17/34; G07F 17/3244; G07F 17/3265
See application file for complete search history.

(56) References Cited

U.S. PATENT DOCUMENTS 1,564,746 A 12/1925 Barnard
1,978,395 A 10/1934 Groetchen
(Continued)

FOREIGN PATENT DOCUMENTS

AU 710015 B2 9/1997
AU 722969 6/1998
(Continued)

OTHER PUBLICATIONS

50 Lions Advertisement, written by videoslotmachines.com, published prior to 2007.
Brokopp, John, "A Study in Slot Machine Research and Development," published at www.casinocitytimes.com on Nov. 30, 2005.
(Continued)

*Primary Examiner* — Damon Pierce
(74) *Attorney, Agent, or Firm* — Neal, Gerber & Eisenberg LLP

(57) ABSTRACT

A gaming system displays a plurality of independent reels, wherein each independent reel generates a symbol from a plurality of symbol positions of that independent reel in accordance with a plurality of probabilities. At least two adjacent independent reels generate symbols according to relatively high probabilities of generating a designated symbol. For a play of the game, the gaming system generates and displays a symbol for each independent reel and provides an award for any displayed winning symbol combinations. In one embodiment, for at least one symbol position of at least one winning symbol combination, the gaming system regenerates a symbol for one or more independent, such as by displaying a symbol from an adjacent symbol position of that independent reel. The gaming system provides an award for any winning symbol combinations and repeats until no winning symbol combinations are displayed.

30 Claims, 12 Drawing Sheets

(56) References Cited

U.S. PATENT DOCUMENTS

| | | | |
|---|---|---|---|
| 3,420,525 | A | 1/1969 | Waders |
| 3,642,287 | A | 2/1972 | Lally et al. |
| 3,735,987 | A | 5/1973 | Ohki |
| 3,977,681 | A | 8/1976 | Deitrich |
| 4,099,722 | A | 7/1978 | Rodesch et al. |
| 4,114,831 | A | 9/1978 | Johnson |
| 4,114,890 | A | 9/1978 | Yamamoto et al. |
| 4,171,814 | A | 10/1979 | Tamano |
| 4,198,052 | A | 4/1980 | Gauselmann |
| 4,200,291 | A | 4/1980 | Hooker |
| 4,326,351 | A | 4/1982 | Heywood et al. |
| 4,357,567 | A | 11/1982 | Rock |
| 4,448,419 | A | 5/1984 | Telnaes |
| 4,573,681 | A | 3/1986 | Okada |
| 4,636,951 | A | 1/1987 | Harlick |
| 4,651,996 | A | 3/1987 | Watkins, Jr. |
| 4,695,053 | A | 9/1987 | Vazquez, Jr. et al. |
| 4,790,537 | A | 12/1988 | Smyth et al. |
| 4,826,169 | A | 5/1989 | Bessho et al. |
| 4,838,552 | A | 6/1989 | Hagiwara |
| 4,874,173 | A | 10/1989 | Kishishita |
| 5,152,529 | A | 10/1992 | Okada |
| 5,205,555 | A | 4/1993 | Hamano |
| RE34,244 | E | 5/1993 | Hagiwara |
| 5,308,065 | A | 5/1994 | Bridgeman et al. |
| 5,332,228 | A | 7/1994 | Schultz |
| 5,364,100 | A | 11/1994 | Ludlow et al. |
| 5,393,061 | A | 2/1995 | Manship et al. |
| 5,395,111 | A | 3/1995 | Inoue |
| 5,423,539 | A | 6/1995 | Nagao |
| 5,431,408 | A | 7/1995 | Adams |
| 5,449,173 | A | 9/1995 | Thomas et al. |
| 5,564,700 | A | 10/1996 | Celona |
| 5,580,053 | A | 12/1996 | Crouch |
| 5,584,764 | A | 12/1996 | Inoue |
| 5,609,524 | A | 3/1997 | Inoue |
| 5,611,535 | A | 3/1997 | Tiberio |
| 5,624,119 | A | 4/1997 | Leake |
| 5,664,998 | A | 9/1997 | Seelig et al. |
| 5,704,835 | A | 1/1998 | Dietz |
| 5,720,662 | A | 2/1998 | Holmes et al. |
| 5,722,891 | A | 3/1998 | Inoue |
| 5,752,881 | A | 5/1998 | Inoue |
| 5,766,074 | A | 6/1998 | Cannon et al. |
| 5,769,716 | A | 6/1998 | Saffari et al. |
| 5,772,506 | A | 6/1998 | Marks et al. |
| 5,807,172 | A | 9/1998 | Piechowiak |
| 5,813,911 | A | 9/1998 | Margolin |
| 5,823,873 | A | 10/1998 | Moody |
| 5,833,238 | A | 11/1998 | Watanabe |
| 5,833,536 | A | 11/1998 | Davids et al. |
| 5,833,537 | A | 11/1998 | Barrie |
| 5,863,249 | A | 1/1999 | Inoue |
| 5,882,260 | A | 3/1999 | Marks et al. |
| 5,927,714 | A | 7/1999 | Kaplan |
| 5,935,002 | A | 8/1999 | Falciglia |
| 5,951,397 | A | 9/1999 | Dickinson |
| 5,980,384 | A | 11/1999 | Barrie |
| 5,984,782 | A | 11/1999 | Inoue |
| 5,997,400 | A | 12/1999 | Seelig et al. |
| 5,997,401 | A | 12/1999 | Crawford |
| 6,027,115 | A | 2/2000 | Griswold et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,086,066 | A | 7/2000 | Takeuchi et al. |
| 6,089,976 | A | 7/2000 | Schneider et al. |
| 6,089,977 | A | 7/2000 | Bennett |
| 6,093,102 | A | 7/2000 | Bennett |
| 6,117,013 | A | 9/2000 | Eiba |
| 6,120,031 | A | 9/2000 | Adams |
| 6,120,376 | A | 9/2000 | Cherry |
| 6,120,377 | A | 9/2000 | McGinnis et al. |
| 6,142,875 | A | 11/2000 | Kodachi et al. |
| 6,149,521 | A | 11/2000 | Sanduski |
| 6,159,095 | A | 12/2000 | Frohm et al. |
| 6,159,096 | A | 12/2000 | Yoseloff |
| 6,174,235 | B1 | 1/2001 | Walker et al. |
| 6,190,254 | B1 | 2/2001 | Bennett |
| 6,203,009 | B1 | 3/2001 | Sines et al. |
| 6,220,959 | B1 | 4/2001 | Holmes, Jr. et al. |
| 6,224,484 | B1 | 5/2001 | Okuda et al. |
| 6,227,971 | B1 | 5/2001 | Weiss |
| 6,241,607 | B1 | 6/2001 | Payne et al. |
| 6,251,013 | B1 | 6/2001 | Bennett |
| 6,254,481 | B1 | 7/2001 | Jaffe |
| 6,270,411 | B1 | 8/2001 | Gura et al. |
| 6,270,412 | B1 | 8/2001 | Crawford et al. |
| 6,290,600 | B1 | 9/2001 | Glasson |
| 6,299,165 | B1 | 10/2001 | Nagano |
| 6,299,170 | B1 | 10/2001 | Yoseloff |
| 6,302,398 | B1 | 10/2001 | Vecchio |
| 6,302,429 | B1 | 10/2001 | Friedrich |
| 6,305,686 | B1 | 10/2001 | Perrie et al. |
| 6,311,976 | B1 | 11/2001 | Yoseloff et al. |
| 6,315,660 | B1 | 11/2001 | DeMar et al. |
| 6,315,663 | B1 | 11/2001 | Sakamoto |
| 6,315,664 | B1 | 11/2001 | Baerlocher |
| 6,318,721 | B1 | 11/2001 | Randall et al. |
| 6,319,124 | B1 | 11/2001 | Baerlocher et al. |
| 6,322,078 | B1 | 11/2001 | Adams |
| 6,347,996 | B1 | 2/2002 | Gilmore et al. |
| 6,358,144 | B1 | 3/2002 | Kaddlic et al. |
| 6,364,766 | B1 | 4/2002 | Anderson et al. |
| 6,394,902 | B1 | 5/2002 | Glavich et al. |
| 6,398,644 | B1 | 6/2002 | Perrie et al. |
| 6,409,602 | B1 | 6/2002 | Wiltshire et al. |
| 6,413,161 | B1 | 7/2002 | Baerlocher et al. |
| 6,413,162 | B1 | 7/2002 | Baerlocher et al. |
| 6,416,408 | B2 | 7/2002 | Tracy et al. |
| 6,419,579 | B1 | 7/2002 | Bennett |
| 6,428,412 | B1 | 8/2002 | Anderson et al. |
| 6,439,993 | B1 | 8/2002 | O'Halloran |
| 6,439,995 | B1 | 8/2002 | Hughs-Baird et al. |
| 6,454,266 | B1 | 9/2002 | Breeding et al. |
| 6,464,581 | B1 | 10/2002 | Yoseloff et al. |
| 6,481,713 | B2 | 11/2002 | Perrie et al. |
| 6,494,454 | B2 | 12/2002 | Adams |
| 6,506,114 | B1 | 1/2003 | Estes et al. |
| 6,514,141 | B1 | 2/2003 | Kaminkow et al. |
| 6,517,432 | B1 | 2/2003 | Jaffe |
| 6,517,433 | B2 | 2/2003 | Loose et al. |
| 6,551,187 | B1 | 4/2003 | Jaffe |
| 6,561,904 | B2 | 5/2003 | Locke et al. |
| 6,565,433 | B1 | 5/2003 | Baerlocher et al. |
| 6,575,830 | B2 | 6/2003 | Baerlocher et al. |
| 6,585,591 | B1 | 7/2003 | Baerlocher et al. |
| 6,589,114 | B2 | 7/2003 | Rose |
| 6,604,740 | B1 | 8/2003 | Singer et al. |
| 6,616,142 | B2 | 9/2003 | Adams |
| 6,632,140 | B2 | 10/2003 | Berman et al. |
| 6,634,945 | B2 | 10/2003 | Glavich et al. |
| 6,641,477 | B1 | 11/2003 | Dietz |
| 6,643,943 | B2 | 11/2003 | Dall'Aglio et al. |
| 6,644,663 | B2 | 11/2003 | Seelig et al. |
| 6,659,864 | B2 | 12/2003 | McGahn et al. |
| 6,666,767 | B1 | 12/2003 | Dayan |
| 6,676,511 | B2 | 1/2004 | Payne et al. |
| 6,676,512 | B2 | 1/2004 | Fong et al. |
| 6,695,696 | B1 | 2/2004 | Kaminkow |
| 6,702,671 | B2 | 3/2004 | Tarantino |
| 6,712,693 | B1 | 3/2004 | Hettinger |
| 6,719,630 | B1 | 4/2004 | Seelig et al. |
| 6,726,204 | B2 | 4/2004 | Inoue |
| 6,731,313 | B1 | 5/2004 | Kaminkow |
| 6,733,386 | B2 | 5/2004 | Cuddy et al. |
| 6,758,750 | B2 | 7/2004 | Baerlocher et al. |
| 6,780,109 | B2 | 8/2004 | Kaminkow |
| 6,802,775 | B2 | 10/2004 | Baerlocher et al. |
| 6,805,349 | B2 | 10/2004 | Baerlocher et al. |
| 6,832,957 | B2 | 12/2004 | Falconer |
| 6,835,133 | B2 | 12/2004 | Baerlocher et al. |
| 6,837,788 | B2 | 1/2005 | Cannon |

(56) References Cited

U.S. PATENT DOCUMENTS 6,855,054 B2 2/2005 White et al.
6,866,583 B2 3/2005 Glavich et al.
6,875,106 B2 4/2005 Weiss et al.
6,880,826 B2 4/2005 Inoue
6,896,617 B2 5/2005 Daly
6,905,406 B2 6/2005 Kaminkow et al.
6,910,962 B2 6/2005 Marks et al.
6,913,533 B2 7/2005 Cuddy et al.
6,921,335 B2 7/2005 Rodgers et al.
6,923,441 B2 8/2005 Inoue
6,932,700 B2 8/2005 Bennett et al.
6,942,571 B1 9/2005 McAllister et al.
6,942,572 B2 9/2005 Inoue
6,955,600 B2 10/2005 Glavich et al.
6,960,133 B1 11/2005 Marks et al.
6,971,955 B2 12/2005 Baerlocher et al.
6,976,915 B2 12/2005 Baker et al.
6,979,263 B2 12/2005 Baerlocher et al.
6,981,635 B1 1/2006 Hughs-Baird et al.
6,986,710 B2 1/2006 Baerlocher et al.
6,991,538 B2 1/2006 Cannon
6,997,804 B2 2/2006 Berman
7,001,274 B2 2/2006 Baerlocher et al.
7,014,560 B2 3/2006 Glavich et al.
7,018,293 B2 3/2006 Brown et al.
7,029,395 B1 4/2006 Baerlocher
7,048,275 B2 5/2006 Adams
7,052,395 B2 5/2006 Glavich et al.
7,056,213 B2 6/2006 Ching et al.
7,070,502 B1 7/2006 Bussick et al.
7,074,127 B2 7/2006 Cuddy et al.
7,077,744 B2 7/2006 Cannon
7,077,745 B2 7/2006 Gomez et al.
7,090,580 B2 8/2006 Rodgers et al.
7,094,148 B2 8/2006 Baerlocher et al.
7,104,886 B2 9/2006 Baerlocher et al.
7,108,602 B2 9/2006 Daly
7,137,888 B2 11/2006 Glavich et al.
7,144,322 B2 12/2006 Gomez et al.
7,153,205 B2 12/2006 Baerlocher
7,160,186 B2 1/2007 Cuddy et al.
7,160,187 B2 1/2007 Loose et al.
7,168,704 B1 1/2007 Lawless
7,169,042 B2 1/2007 Muir et al.
7,195,559 B2 3/2007 Gilmore et al.
7,204,753 B2 4/2007 Ozaki et al.
7,226,359 B2 6/2007 Bussick et al.
7,236,113 B1 6/2007 Wang
7,238,110 B2 7/2007 Glavich et al.
7,252,591 B2 8/2007 Van Asdale
7,252,592 B2 8/2007 Rodgers et al.
7,275,988 B2 10/2007 Aida et al.
7,294,058 B1 11/2007 Slomiany et al.
7,309,281 B2 12/2007 Baerlocher et al.
7,309,282 B2 12/2007 Baerlocher et al.
7,331,862 B2 2/2008 Rodgers et al.
7,331,866 B2 2/2008 Rodgers et al.
7,331,867 B2 2/2008 Baerlocher et al.
7,357,713 B2 4/2008 Marks et al.
7,371,169 B2 5/2008 Baerlocher
7,371,170 B2 5/2008 Cregan et al.
7,374,486 B2 5/2008 Baerlocher
7,384,334 B2 6/2008 Glavich et al.
7,396,279 B2 7/2008 Berman et al.
7,399,225 B2 7/2008 Kaminkow
7,410,420 B2 8/2008 Shiraishi
7,442,123 B2 10/2008 Brill et al.
7,455,588 B2 11/2008 Webb et al.
7,465,227 B2 12/2008 Baerlocher
7,470,185 B2 12/2008 Baerlocher
7,473,173 B2 1/2009 Peterson et al.
7,473,174 B2 1/2009 Cuddy et al.
2002/0010017 A1 1/2002 Bennett
2002/0068623 A1 6/2002 Gauselmann
2002/0077165 A1 6/2002 Bansemer et al.
2002/0160836 A1 10/2002 Watanabe et al.
2003/0045345 A1 3/2003 Berman
2003/0054874 A1 3/2003 Kaminkow
2003/0057645 A1 3/2003 Baerlocher et al.
2003/0060267 A1 3/2003 Glavich et al.
2003/0073480 A1 4/2003 Thomas et al.
2003/0100356 A1 5/2003 Brown et al.
2003/0125100 A1 7/2003 Cannon
2003/0157981 A1 8/2003 Marks et al.
2003/0203752 A1 10/2003 Kaminkow et al.
2003/0203753 A1 10/2003 Muir et al.
2003/0207710 A1 11/2003 Rodgers et al.
2004/0012145 A1 1/2004 Inoue
2004/0014516 A1 1/2004 Inoue
2004/0014517 A1 1/2004 Inoue
2004/0018866 A1 1/2004 Inoue
2004/0026854 A1 2/2004 Inoue
2004/0033827 A1 2/2004 Gilmore et al.
2004/0033829 A1 2/2004 Pacey et al.
2004/0036218 A1 2/2004 Inoue
2004/0038726 A1 2/2004 Inoue
2004/0043809 A1 3/2004 Gomez et al.
2004/0048650 A1 3/2004 Mierau et al.
2004/0048651 A1 3/2004 Vorias et al.
2004/0053669 A1 3/2004 Gerrard et al.
2004/0053672 A1 3/2004 Baerlocher
2004/0053676 A1 3/2004 Rodgers
2004/0072612 A1 4/2004 Rodgers et al.
2004/0097280 A1 5/2004 Gauselmann
2004/0102236 A1 5/2004 Suda et al.
2004/0132527 A1 7/2004 Berman et al.
2004/0137982 A1 7/2004 Cuddy et al.
2004/0147306 A1 7/2004 Randall et al.
2004/0242313 A1 12/2004 Munoz
2005/0020344 A1 1/2005 Kaminkow
2005/0049035 A1 3/2005 Baerlocher et al.
2005/0054405 A1 3/2005 Baerlocher et al.
2005/0054418 A1 3/2005 Baerlocher
2005/0054429 A1 3/2005 Baerlocher et al.
2005/0059446 A1 3/2005 Kaminkow
2005/0059477 A1 3/2005 Baerlocher
2005/0059478 A1 3/2005 Peterson et al.
2005/0064924 A1 3/2005 Glavich et al.
2005/0070354 A1 3/2005 Baerlocher et al.
2005/0101380 A1 5/2005 Glavich et al.
2005/0119403 A1 6/2005 St. Clair
2005/0148381 A1 7/2005 Marks et al.
2005/0148384 A1 7/2005 Marks et al.
2005/0159210 A1 7/2005 Satoh
2005/0192081 A1 9/2005 Marks et al.
2005/0227754 A1 10/2005 Kaminkow et al.
2005/0282620 A1 12/2005 Marks et al.
2005/0288094 A1 12/2005 Marks et al.
2006/0019738 A1 1/2006 Baerlocher et al.
2006/0030392 A1 2/2006 Rodgers et al.
2006/0030398 A1 2/2006 Hornik
2006/0040728 A1 2/2006 Fuller
2006/0046830 A1 3/2006 Webb
2006/0058097 A1 3/2006 Berman et al.
2006/0068875 A1 3/2006 Cregan et al.
2006/0068882 A1 3/2006 Baerlocher et al.
2006/0068884 A1 3/2006 Baerlocher et al.
2006/0068885 A1 3/2006 Cregan et al.
2006/0073872 A1 4/2006 B-Jensen et al.
2006/0073876 A1 4/2006 Cuddy
2006/0084492 A1 4/2006 Baerlocher et al.
2006/0084494 A1 4/2006 Belger et al.
2006/0084498 A1 4/2006 Baerlocher et al.
2006/0089191 A1 4/2006 Singer et al.
2006/0111174 A1 5/2006 Baerlocher et al.
2006/0116195 A1 6/2006 Baerlocher et al.
2006/0135247 A1 6/2006 Baerlocher et al.
2006/0172795 A1 8/2006 Bussick et al.
2006/0199636 A1 9/2006 Ching et al.
2006/0199637 A1 9/2006 Ching et al.
2006/0264254 A1 11/2006 Aoki
2007/0004489 A1 1/2007 Rodgers et al.
2007/0010316 A1 1/2007 Baerlocher et al.
2007/0021175 A1 1/2007 Rodgers et al.

(56) References Cited

U.S. PATENT DOCUMENTS

| | | | |
|---|---|---|---|
| 2007/0021188 | A1 | 1/2007 | Rodgers et al. |
| 2007/0060246 | A1 | 3/2007 | Baerlocher et al. |
| 2007/0060248 | A1 | 3/2007 | Rodgers et al. |
| 2007/0060255 | A1 | 3/2007 | Baerlocher et al. |
| 2007/0060294 | A1 | 3/2007 | Cuddy et al. |
| 2007/0087812 | A1 | 4/2007 | Glavich et al. |
| 2007/0149270 | A1 | 6/2007 | Baerlocher et al. |
| 2007/0287523 | A1 | 12/2007 | Esses et al. |
| 2008/0051174 | A1 | 2/2008 | Fiden |
| 2008/0090655 | A1 | 4/2008 | Marks |
| 2008/0102931 | A1 | 5/2008 | Marks |
| 2008/0108411 | A1 | 5/2008 | Jensen et al. |
| 2008/0113735 | A1 | 5/2008 | Maya |
| 2008/0113743 | A1 | 5/2008 | Dunaevsky |
| 2008/0113765 | A1 | 5/2008 | DeWaal |
| 2008/0132320 | A1 | 6/2008 | Rodgers |
| 2008/0139269 | A1 | 6/2008 | Toyoda |
| 2008/0139298 | A1 | 6/2008 | Rodgers et al. |
| 2008/0161097 | A1 | 7/2008 | Baerlocher et al. |
| 2008/0200232 | A1 | 8/2008 | Baerlocher et al. |

FOREIGN PATENT DOCUMENTS

| | | | |
|---|---|---|---|
| AU | 199917318 | A1 | 9/1999 |
| AU | 755879 | | 2/2001 |
| EP | 0 058 488 | | 8/1982 |
| EP | 0 060 019 | | 9/1982 |
| EP | 0 874 337 | | 10/1998 |
| EP | 0 981 119 | | 2/2000 |
| EP | 0 984 408 | | 3/2000 |
| EP | 1 063 622 | | 12/2000 |
| EP | 1 184 822 | | 3/2002 |
| EP | 1 205 894 | | 5/2002 |
| EP | 1 422 673 | | 5/2004 |
| EP | 1 513 117 | | 3/2005 |
| GB | 1 454 046 | | 10/1976 |
| GB | 2 062 922 | | 5/1981 |
| GB | 2 106 293 | | 9/1981 |
| GB | 2 081 952 | | 2/1982 |
| GB | 2 090 690 | | 7/1982 |
| GB | 2 096 376 | | 10/1982 |
| GB | 2 097 160 | | 10/1982 |
| GB | 2 100 905 | | 1/1983 |
| GB | 2 105 891 | | 3/1983 |
| GB | 2 106 295 | | 4/1983 |
| GB | 2 113 881 | | 8/1983 |
| GB | 2 117 155 | | 10/1983 |
| GB | 2 137 392 | | 10/1984 |
| GB | 2 161 008 | | 1/1986 |
| GB | 2 165 385 | | 4/1986 |
| GB | 2 170 636 | | 8/1986 |
| GB | 2 180 087 | A | 3/1987 |
| GB | 2 181 589 | | 4/1987 |
| GB | 2 183 882 | | 6/1987 |
| GB | 2 191 030 | | 12/1987 |
| GB | 2 222 712 | | 3/1990 |
| GB | 2 225 889 | | 6/1990 |
| GB | 2 226 436 | | 6/1990 |
| GB | 2 242 300 | | 9/1991 |
| GB | 2 243 236 | | 10/1991 |
| GB | 2 262 642 | | 6/1993 |
| GB | 2 322 217 | A | 8/1998 |
| GB | 2 335 524 | A | 9/1999 |
| GB | 2 372 132 | | 8/2002 |
| GB | 2 372 617 | | 8/2002 |
| GB | 2 393 555 | A | 3/2004 |
| WO | WO 97/32285 | | 9/1997 |
| WO | WO 98/20949 | | 5/1998 |
| WO | WO 00/30727 | | 6/2000 |
| WO | WO 00/32286 | | 6/2000 |
| WO | WO 00/66235 | | 11/2000 |
| WO | WO 00/76606 | | 12/2000 |
| WO | WO 01/26019 | | 4/2001 |
| WO | WO 03/026759 | | 4/2003 |
| WO | WO 2004/025584 | | 3/2004 |
| WO | WO 2005/028043 | | 3/2005 |
| WO | WO 2006/028860 | | 3/2006 |
| WO | WO 2006/033845 | | 3/2006 |
| WO | WO 2006/036516 | | 4/2006 |
| WO | WO 2006/076294 | | 7/2006 |
| WO | WO 2007/002935 | | 1/2007 |
| WO | WO 2007/053349 | | 5/2007 |
| WO | WO 2007/084766 | | 7/2007 |
| WO | WO 2007/130443 | | 11/2007 |
| WO | WO 2007/130444 | | 11/2007 |

OTHER PUBLICATIONS

All That Glitters website, written by WMS Gaming, published on or before Nov. 2007.

"Barn Yard by Aristocrat," article written by Strictly Slots, published Mar. 2002.

Bejeweled Web site, written by PopCap Games, http://www.popcap.com, published prior to Sep. 9, 2005.

Black Swan Paytable Display, written by IGT, published prior to 2001.

Break the Spell Advertisement, written by Atronic Casino Technology, Ltd., published prior to Jan. 1, 2000.

"Cash Chameleon" article, written by Strictly Slots/Aristocrat Leisure Industries, PTY Ltd., published in Apr. 2001.

Catch A Wave Advertisement, written by IGT, published in Dec. 2000.

Cossack Dancer Advertisement, written by Olympic Video Gaming, published prior to 2002.

"Expanding Symbol," Description, written by IGT, published Sep. 1999.

"Gaming Machine with Animating Symbols," Description, written by IGT, published Jan. 2000.

"Symbol Feature in Australian UFO Gaming Machine," Description written by Barcrest, Ltd., published 1995.

"Traveling Symbols," Description, written by IGT, published Sep. 1999.

Double Diamond Line Advertisement, written by Bally Gaming Systems, published in 2000.

Easy Street Advertisements and Articles, written by Casino Data Systems, published in 2000.

ENCHANTED FOREST™ Gaming Description from Aristocrat, available in 1994.

Enchanted Unicorn Advertisement, written by IGT, published in 2001.

"Fishin' Buddies" article, published in Strictly Slots/Anchor Games, published in Apr. 2001.

"Ghoulish Gamble" article, written by Strictly Slots/IGT, published Sep. 2000.

Gold Fever Advertisement, written by Atronic Casino Technology, Ltd., published 1999.

Gold Fever by Atronic Web Site, written by Atronic Casino Technology, published Mar. 2002.

"Goooaal!" written by Bally Gaming, Inc., published Dec. 2000.

"It's A Blast," written by IGT, published on or before Dec. 2004.

Jewel in the Crown Advertisements, written by Barcrest Ltd., published 1999.

Joker's Wild Advertisement, written by IGT, published prior to 2001.

"Juicy Loot" by Bally Technologies, article from Strictly Slots, published Feb. 2008.

Kaboom game Web Site, including relevant portions of multiple web pages, written by WMS Gaming, http://www.wmsgaming.com/products/video/kaboom/index.php, published prior to Sep. 9, 2005.

Kaboom game website, written by WMS Gaming, published on or before Nov. 2007.

Loco Loot Article, written by Strictly Slots/Aristocrat Leisure Industries, PTY Ltd., published in May 2002.

Fey, Marshall, "Slot Machines," published by Reno-Tahoe Specialty, Inc., pp. 1-34, 1989.

"Mountain Money" article, written by Strictly Slots/Aristocrat Leisure Industries, PTY Ltd., published in Jun. 2002.

Mystery Mine Advertisement, Konami Australia Pty. Ltd., published Jan. 1999.

(56) References Cited

OTHER PUBLICATIONS

On the House Advertisement, written by Olympic Video Gaming, published prior to 2002.
Penguin Pays Advertisement, written by Aristocrat Incorporated, published in 1998.
"REEL MAGIC™ Gaming Machine," Description written by IGT, available in 1986.
South Park Advertisement, written by IGT, published Sep. 1999.
Wild Bear Salmon Run Advertisement, written by IGT, published in 2003.
Wild Streak Advertisement, written by WMS Gaming, Inc., published in 2001.
Wolf Run Video Slots Advertisment, written by IGT, published in 2006.
Your Real Key to Gaming Success Advertisement (including Roll Over Beethoven and Wild Fortune) written by Olympic Video Gaming, available prior to Jun. 2007.

400

Table A

| Symbol (410) | Number (420) |
|---|---|
| A (410a) | 1 |
| K (410b) | 2 |
| Q (410c) | 3 |
| J (410d) | 4 |
| 10 (410e) | 5 |
| K | 6 |
| K | 7 |
| K | 8 |
| K | 9 |
| K | 10 |
| K | 11 |
| K | 12 |
| K | 13 |
| K | 14 |
| K | 15 |
| K | 16 |
| K | 17 |
| K | 18 |
| K | 19 |
| K | 20 |

410b

450

Table B

| Symbol (460) | Number (470) |
|---|---|
| A (410a) | 1 |
| K (410b) | 2 |
| Q (410c) | 3 |
| J (410d) | 4 |
| 10 (410e) | 5 |
| A (410a) | 6 |
| K (410b) | 7 |
| Q (410c) | 8 |
| J (410d) | 9 |
| 10 (410e) | 10 |
| A (410a) | 11 |
| K (410b) | 12 |
| Q (410c) | 13 |
| J (410d) | 14 |
| 10 (410e) | 15 |
| A (410a) | 16 |
| K (410b) | 17 |
| Q (410c) | 18 |
| J (410d) | 19 |
| 10 (410e) | 20 |

GAMING SYSTEM AND METHOD FOR PROVIDING A CASCADING SYMBOL GAME INCLUDING A PLURALITY OF INDEPENDENT REELS WHICH PROVIDE A STACKED SYMBOL FUNCTIONALITY

PRIORITY CLAIM

This application is a continuation of, claims priority to and the benefit of U.S. patent application Ser. No. 12/271,504, filed on Nov. 14, 2008, the entire contents of which is incorporated by reference herein.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and is also based on the amount of the wager (e.g., the higher the wager, the higher the award). Generally, symbols or symbol combinations which are less likely to occur provide higher awards. In such known gaming machines, the amount of the wager made on the base game by the player can vary.

Certain known gaming machines provide reel games implemented using a plurality of independent reels, wherein each independent reel is configured to generate a single symbol for a spin of the reel. Such gaming machines display the plurality of independent reels in a matrix or other arrangement of independent reels. For a play of a game provided by such gaming machines, the gaming machine generates and displays a plurality of symbols by spinning each independent reel. The gaming machine provides an award for any winning symbol or winning symbol combination displayed by the plurality of independent reels.

Symbol stacking in a reel game is also known. Symbol stacking is implemented by forming stacks of one or more identical symbols in adjacent symbol positions of a reel strip utilized by a single reel. The identical symbols on the same single reel are adjacent to each other, and thus "stacked." For example, in a slot game with three rows of symbols, three cherry symbols may appear adjacent to each other on a reel to form a stack of three cherry symbols. For a spin of the stacked reel of such a slot game, part or all of a stack of symbols can be displayed in a viewing area of the gaming machine. In one known slot gaming device, when a gaming machine generates stacks of symbols that are identical on three or more adjacent reels, multiple winning symbol combinations can be formed and the gaming machine can provide large payouts to the player if portions of one or more stacks of symbols are displayed.

Gaming machines which provide cascading symbol games are also known. In one such cascading symbol game, a gaming machine generates and displays a plurality of symbols in a plurality of symbol positions. The gaming machine evaluates the displayed symbols and provides an award for each winning symbol combination formed. The gaming machine then removes the displayed symbols that form the winning symbol combination(s) to create one or more empty symbol positions. The gaming machine shifts zero, one, or more of the remaining displayed symbols downward into zero, one, or more of the empty symbol positions and generates and displays a symbol for each remaining empty symbol position. The gaming machine re-evaluates the displayed symbols, provides an award for any displayed winning symbol combinations and repeats the steps of removing symbols, shifting symbols, generating new symbols, and evaluating symbol combinations until no winning symbol combination is displayed.

There is a continuing need to increase the excitement and entertainment experienced by people playing gaming machines. There is a further need for increasing the number of winning symbol combinations generated and awards provided to a player for a single play of a game.

SUMMARY

The present disclosure relates generally to gaming systems and methods for providing a cascading or tumbling symbol game including a plurality of independent reels with stacked symbols. More particularly, the present disclosure relates to a gaming system which includes a plurality of independent reels arranged as a matrix of independent reels. Each independent reel is associated with a virtual reel strip which includes a plurality of symbols in a plurality of symbol positions, wherein the symbols are displayable for spins of that independent reel. Each symbol of each independent reel also has a probability of being generated for a spin of that independent reel. At least two adjacent independent reels are each associated with a virtual reel strip which provides a relatively high probability of generating a same designated symbol. Moreover, at least one of the plurality of independent reels is associated with a virtual reel strip having a same designated symbol in a plurality of adjacent symbol positions of that virtual reel strip.

In operation of one embodiment, the gaming system disclosed herein generates one of the symbols of each independent reel by randomly selecting that symbol from among the plurality of symbols of each associated virtual reel strip. The gaming system provides an award based on any generated winning symbol combinations. In one embodiment, the gaming system then generates a different symbol for at least one of the independent reels, such as by displaying a symbol which is adjacent to a previously displayed symbol of a virtual reel strip. The gaming system determines whether any new winning symbol combinations are displayed and provides any appropriate award. Since, as described above, at least two adjacent independent reels are each associated with a virtual reel strip having a relatively high probability of generating the same designated symbol, the gaming system provides a stacked symbol effect with respect to the designated symbol for each new symbol generation. Moreover, since the gaming system includes at least one independent reel associated with a reel strip having a plurality of adjacent designated symbols, the gaming system also provides a stacked symbol effect with respect to the designated symbol for each re-generation of a symbol for such stacked independent reels. Thus, the gaming system is relatively likely to display the designated symbol for a plurality of subsequent generations by that independent reel, increasing the probability of winning multiple awards for a play of the game.

In one embodiment, the gaming system disclosed herein includes a plurality of independent reels displayed as a matrix of independent reels. Each independent reel includes a plurality of symbols in a plurality of symbol positions, wherein any of the symbols can be generated for a spin of that independent reel. In one embodiment, each independent reel is associated with a virtual reel strip which includes a plurality of symbols. In another embodiment, each independent reel utilizes a table including a plurality of symbols. In various embodiments, each symbol of each independent reel includes a probability of being generated for a spin of that independent reel. For example, a first independent reel utilizes a reel strip including a designated symbol, the symbols of the first independent reel being generated in accordance with an 80% chance of generating the designated symbol. In this example, a second independent reel utilizes a reel strip which generates symbols in accordance with a 70% chance of generating the same designated symbol.

In one embodiment, the gaming system is configured such that at least two adjacent independent reels each utilize a table and/or a virtual reel strip which includes a relatively high probability of generating a same designated symbol. In one such embodiment, each of the adjacent independent reels utilizes a same reel strip. In another embodiment, each of the adjacent independent reels utilize different virtual reel strips having different (and relatively high) probabilities of generating the same designated symbol. Continuing with the example discussed above, the first and second tables are utilized by independent reels which are adjacent to one another such that each adjacent independent reel has at least a 70% chance of generating the designated symbol for a spin of each symbol generation or re-generation of that independent reel. It should be appreciated that this arrangement of independent reels adjacent independent reels which each have at least a 70% percent chance of generating the designated symbol) results in the stacked symbol effect with respect to the designated symbol for an initial, random generation by the plurality of independent reels due to the relatively high likelihood of simultaneously generating the designated symbol for at least two adjacent independent reels.

In one embodiment, at least one of the independent reels provides a stacked symbol effect with respect to the designated symbol. In this embodiment, any independent reel which provides a stacked symbol effect includes a plurality of symbols displayed in a plurality of symbol positions of a virtual reel strip, wherein at least two adjacent symbol positions of the virtual reel strip include the designated symbol. For such a stacked independent reel, the gaming system is relatively likely to generate and display the designated symbol a plurality of times for a plurality of symbol generations. For example, the virtual reel strip of a stacked independent reel includes the designated symbol in four adjacent symbol positions.

In one embodiment, for a play of the game, the gaming system randomly generates and displays a symbol for each independent reel (such as by spinning the independent reels) based on the probabilities defined by the virtual reel strip or table utilized by that independent reel. In this embodiment, the gaming system determines whether the displayed symbols form any winning symbol combinations. If any winning symbol combinations are formed, the gaming system provides an award for such whining symbol combinations. In one embodiment, the gaming system determines at least one independent reel for which to re-generate a symbol by displaying a symbol in an adjacent symbol position of the virtual reel strip. In one embodiment, the gaming system determines such an independent reel based on the independent reels which displayed a symbol included in a winning symbol combination. In another embodiment, the gaming system determines such an independent reel based on independent reels which displayed the designated symbol. In one embodiment, for each determined independent reel, the gaming system activates that independent reel to display a symbol of an adjacent symbol position of the virtual reel strip associated with that independent reel. The gaming system determines whether any new winning symbol combinations are displayed and provides an award for such newly displayed winning symbol combinations. In the example discussed above, wherein at least one of the reels includes five adjacent designated symbols, the gaming system displays a first one of the five adjacent designated symbols for an initial generation of symbols, and displays a second one of the five adjacent symbols upon the re-generation for the play of the game. It should be appreciated that in this example, the gaming system can display the designated symbol for as many as five generations of symbols for the at least one example independent reel.

It should be appreciated that by providing a plurality of independent reels wherein at least two adjacent independent reels each have a relatively high probability of generating a same designated symbol, the disclosed gaming system provides a game having a stacked symbol effect with respect to the designated symbol for an initial generation of symbols. That is, the disclosed gaming system provides an increased probability of generating winning symbol combinations or winning symbol combinations associated with higher award values based on the relatively high probability of generating designated symbols for initial spins of two or more adjacent independent reels. Moreover, because the designated symbols are in adjacent symbol positions of a virtual reel strip (i.e., the symbols are stacked) for one or more of the independent reels, an activation of such an independent reel to display an adjacent symbol to the currently displayed designated symbol has a relatively high probability of displaying another designated symbol. Thus, the stacked symbol effect provided by the disclosed gaming system increases the probability of generating a plurality of different winning symbol combinations for a play of the game.

Additional features and advantages are described in, and will be apparent from, the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
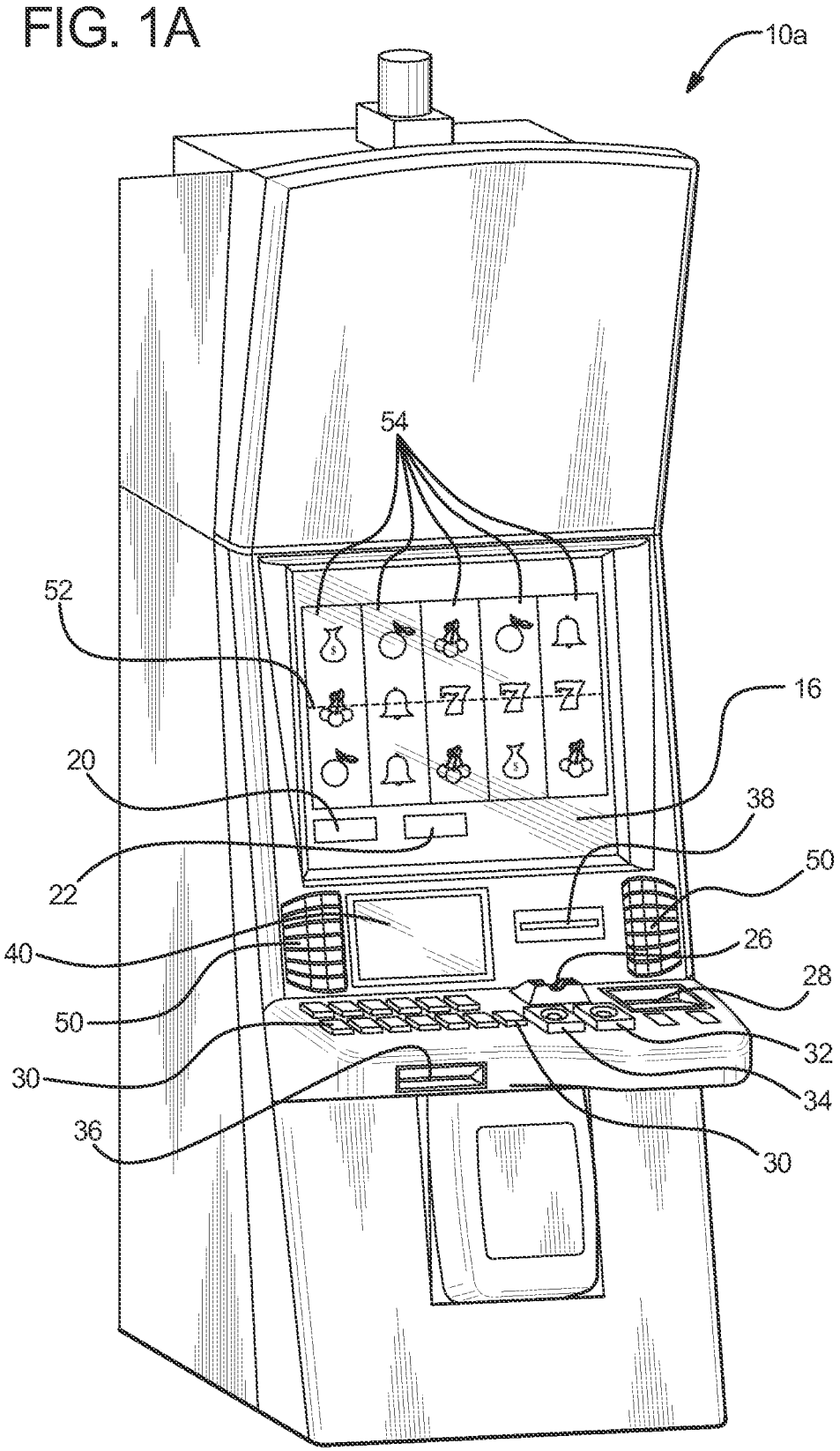
FIGS. 1A and 1B are perspective views of example alternative embodiments of the gaming device of the present disclosure.
Figure 1B:
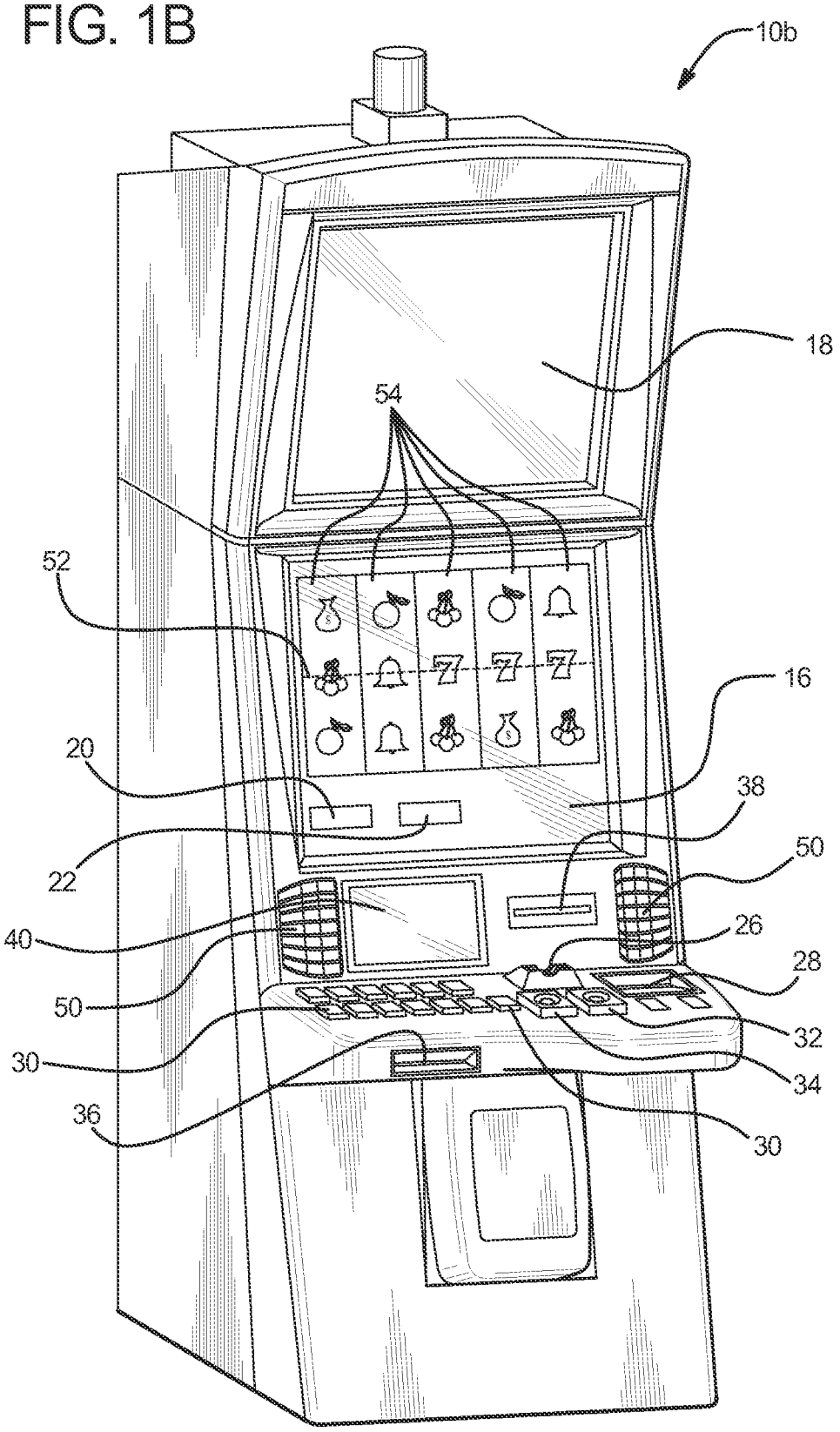

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
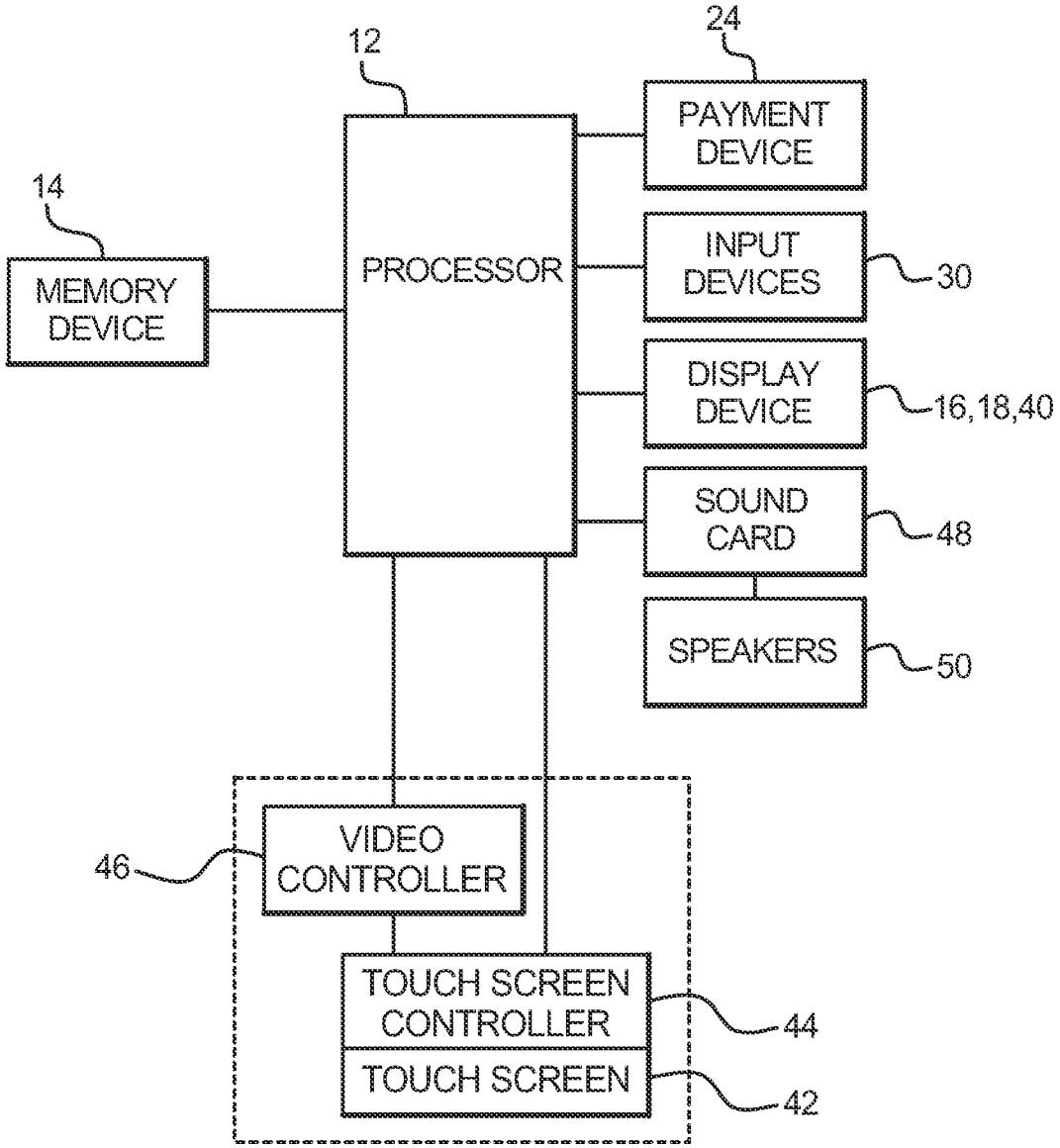
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASICs). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or controller.

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent be or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
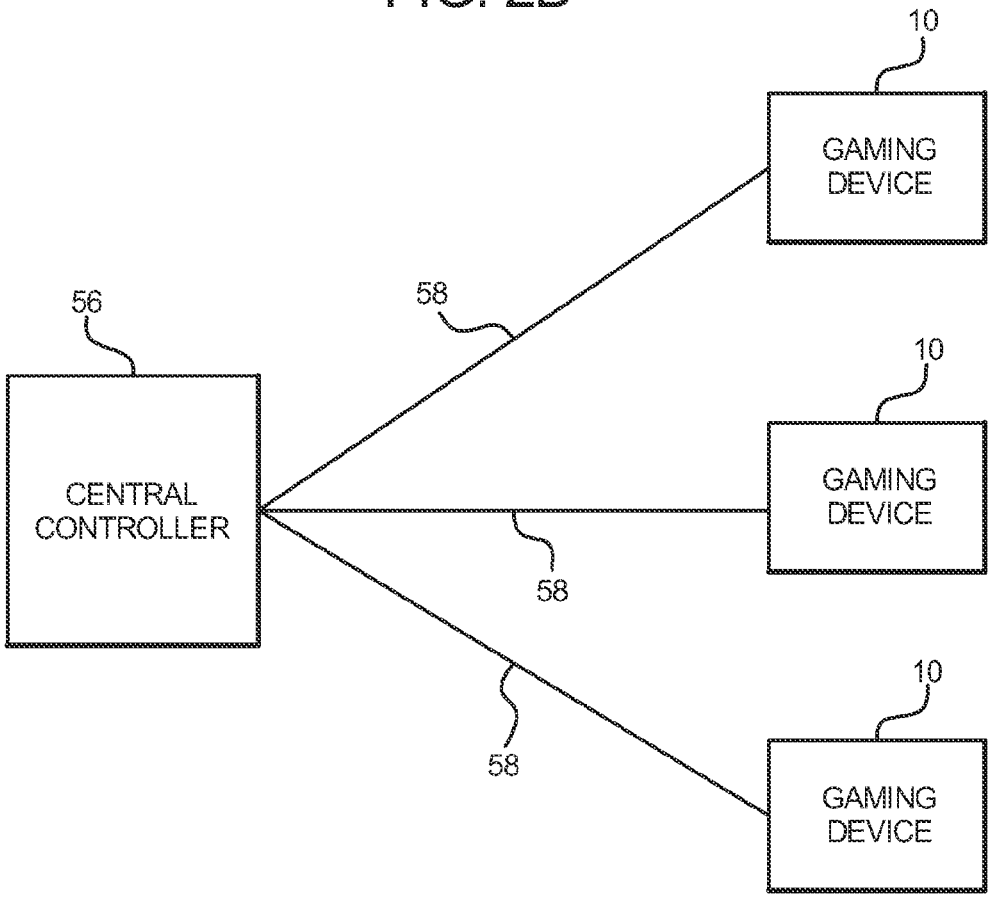
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or online accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internee, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

The present disclosure may be implemented in various configurations for gaming machines, gaming devices, or gaming systems, including but not limited to: (1) a dedicated gaming machine, gaming device, or gaming system.

Gaming System Providing Stacks of Symbols Using Independent Reels

In one embodiment, the gaming system disclosed herein includes or displays a plurality of independent reels arranged as a matrix of independent reels. In one embodiment, each independent reel includes a plurality of symbols in a plurality of symbol positions, and is associated with a probability of generating each of the plurality of symbols. In one embodiment, each independent reel is associated with a virtual reel strip and/or a table which define a plurality of probabilities of generating the plurality of symbols. At least two adjacent independent reels (such as two independent reels positioned horizontally adjacent to one another) each utilize or are associated with a virtual reel strip and/or a table defining a relatively high probability of generating a same designated symbol. Due to the adjacent independent reels which are relatively likely to generate the designated symbol, the gaming system disclosed herein is configured to provide a game with a relatively high probability of generating one or more adjacent designated symbols for an initial generation of symbols and for one or more re-generations of symbols during a play of a game, thus causing a stacked symbol effect with respect to the designated symbol.

Figure 3:
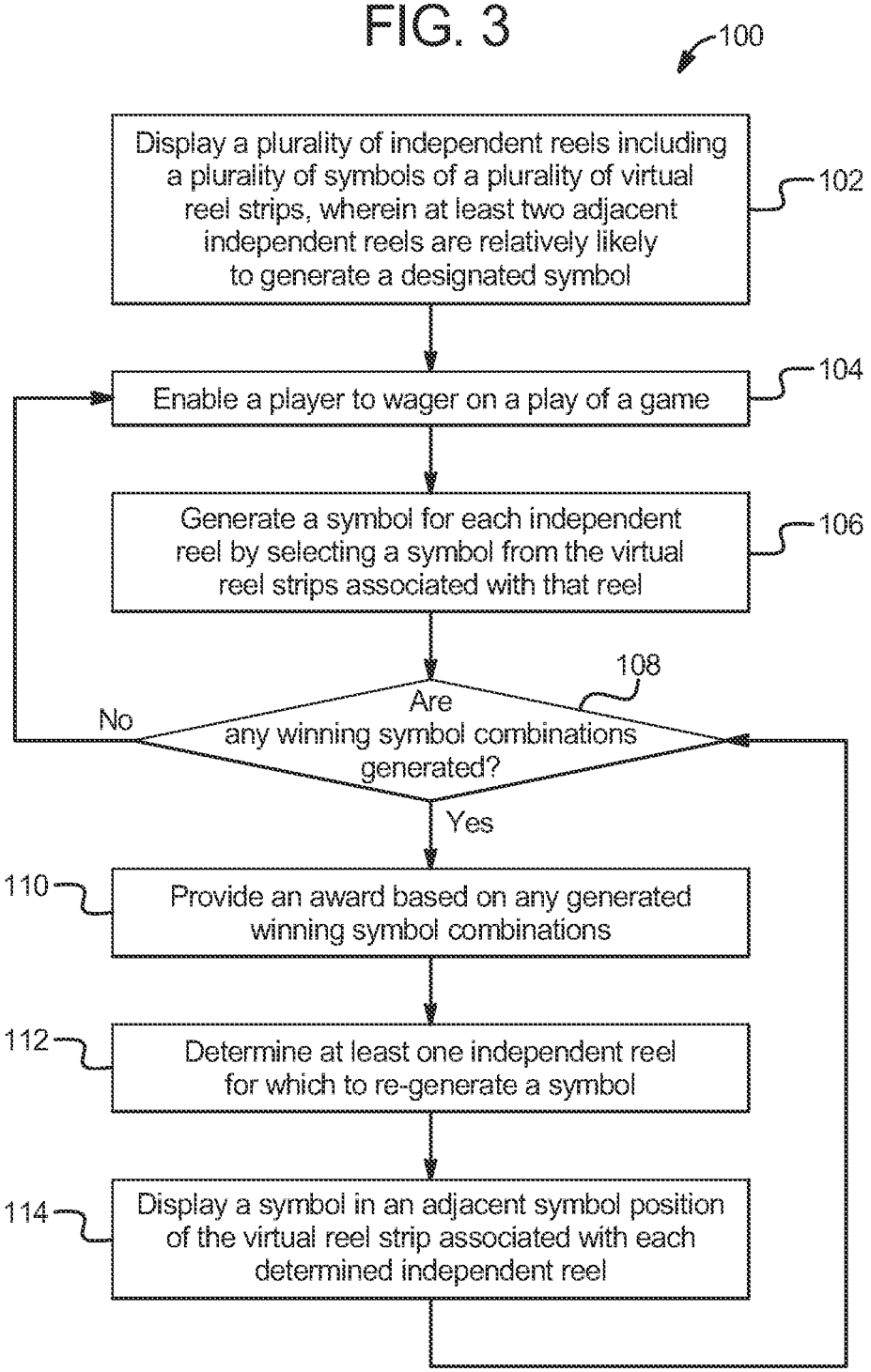
FIG. 3 a flow chart of an example process for operating a gaming system providing the independent reel game providing a stacked symbol effect as disclosed herein.

FIG. 3 illustrates a flow chart of an example process 100 for operating a gaming system providing the independent reel game having a stacked symbol effect as disclosed herein. Although the example process 100 for operating the gaming system for providing the stacked symbol game is described with reference to the flow chart illustrated in FIG. 3, many other methods of operating such a gaming system are contemplated. For example, the order of certain of the blocks may be changed, and certain of the blocks described are optional.

In one embodiment, the disclosed gaming system displays a plurality of independent reels, as indicated in block 102. In one such embodiment, the gaming system displays the plurality independent reels as a matrix of independent reels, such that each independent reel is adjacent to at least one other independent reel. In this embodiment, each independent reel includes a plurality of symbols, such that a spin of that independent reel results in a display of one of the plurality of symbols.

In one embodiment, each of the independent reels is associated with a virtual reel strip, as indicated by block 102. In one such embodiment, each virtual reel strip includes a plurality of symbols in a plurality of symbol positions, the symbols being displayable for a spin of the independent reel. In this embodiment, each symbol has a probability of being generated for a spin of the independent reel. In one embodiment, each virtual reel strip is associated with a table which defines the probabilities of generating the symbols of that independent reel. In various embodiments, for a spin of any of the independent reels, the disclosed gaming system selects one of the symbols for the independent reel to display in accordance with the defined probabilities.

In one embodiment, at least two adjacent independent reels each have virtual reel strips associated with a table of symbols having a relatively high probability of generating a designated symbol, as indicated by block 102. In one embodiment, such independent reels (i.e., independent reels which are relatively likely to generate the designated symbol) are referred to as weighted independent reels with respect to the designated symbol. In one such embodiment, the adjacent weighted independent reels are horizontally adjacent to one another. In another embodiment, the adjacent weighted independent reels are vertically adjacent to one another. In various embodiments, the gaming system provides more than two adjacent weighted independent reels. In one embodiment, the gaming system provides a cluster or clump of weighted independent reels, such that two or more weighted independent reels are horizontally adjacent to each other and two or more weighted independent reels are vertically adjacent to each other.

In one embodiment, the disclosed gaming system enables a player to wager on a play of the game including the plurality of independent reels, as indicated by block 104. In one embodiment, for the play of the game, the gaming system generates a symbol for each of the plurality of independent reels, as indicated by block 106. In one such embodiment, the gaming system generates the plurality of symbols by selecting one of the numbers associated with one of the symbols of the table, such as based on an output of a random number generator, and by displaying the appropriate symbol of the virtual reel strip. In another embodiment, each of the independent reels is a mechanical reel, and the gaming system generates a symbol for each of the independent reels by spinning that mechanical reel. It should be appreciated that the instant disclosure contemplates any suitable method of determining a random symbol for display by an independent reel based on a probability associated with that symbol.

In one embodiment, the gaming system determines whether any winning symbol combinations are generated for the play of the game, as indicated by block 108. It should be appreciated that in various embodiments, by displaying at least two adjacent independent reels which are weighted toward generating the designated symbol, the disclosed gaming system increases the probability of generating winning symbol combinations for plays of the game. In one embodiment, if no winning symbol combination is generated, the gaming system ends the play of the game and enables the player to wager again on a play of the game, as indicated by block 104.

In one embodiment, if at least one winning symbol combination is generated, the gaming system provides an award based on any generated winning symbol combinations, as indicated by block 110. In this embodiment, the gaming system determines at least one independent reel for which to re-generate a symbol for the play of the game, as indicated by block 112. In one such embodiment, the at least one determined independent reel is an independent reel displaying a symbol included in a winning symbol combination, as indicated by block 112.

In one embodiment, the gaming system re-generates a symbol for display by any determined independent reels, as indicated by block 114. Specifically, the gaming system in one embodiment displays a symbol for that independent reel which is in a symbol position of the associated virtual reel strip adjacent to the symbol position of the currently displayed symbol of the associated virtual reel strip. It should be appreciated that if the currently displayed symbol is a designated symbol, the gaming system is relatively likely to re-generate and display another designated symbol due to the plurality of adjacent (i.e., stacked) designated symbols of one or more of the independent reels disclosed herein.

In one embodiment, based on any re-generated symbols, the gaming system determines whether any new winning symbol combinations are displayed, as indicated in block 108. If any new winning symbol combinations are displayed, the gaming system provides an award as indicated by block 110 and re-generates one or more symbols for one or more independent reels, as indicated by blocks 112 and 114. In one embodiment, if the gaming system determines that no additional winning symbol combinations are generated, as indicated by block 108, the gaming system ends the play of the game and enables the player to wager on a new play of the game, as indicated by block 104.

In an alternative embodiment, the gaming system disclosed herein does not re-generate any symbols for a play of the game. In this embodiment, upon providing the determined award based on any winning symbol combinations, as indicated by block 110, the gaming system ends the play of the game. In another embodiment, the gaming system performs at least one re-generation of symbols for a play of the game, up to a maximum number of re-generations. That is, the gaming system performs the loop indicated by block 108, 110, 112, and 114 a plurality of times up to a maximum number of times. In various such embodiments, the maximum number of regenerations is predetermined, randomly determined, determined based on a generated symbol or symbol combination, determined based on a quantity of designated symbols of the independent reel, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools, or determined based on any other suitable method or criteria.

Figures 4, 5:
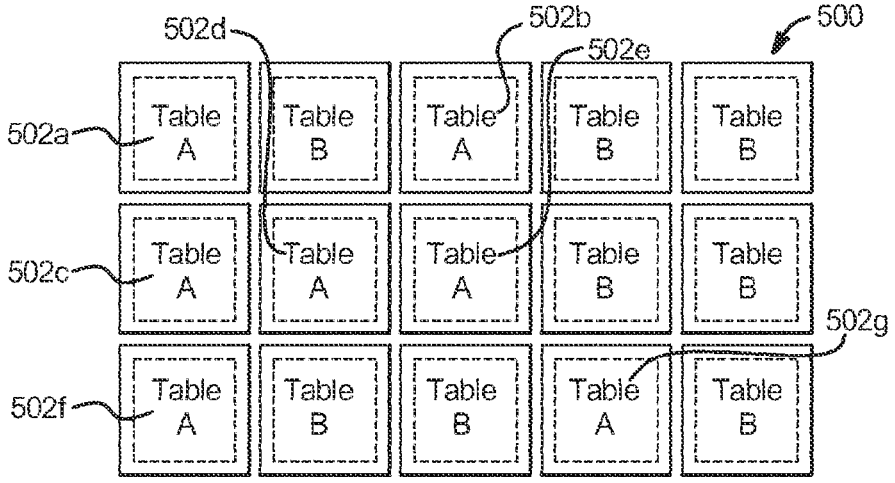
FIG. 4 is a schematic representation of two different tables usable by a plurality of independent reels of the disclosed gaming system.
FIG. 5 is a schematic representation of a plurality of independent reels arranged in a matrix of independent reels which indicates the table utilized by each independent reel to generate symbols for plays of the game.

FIG. 4 illustrates a schematic representation of two different tables usable by a plurality of independent reels of the disclosed gaming system to generate symbols for plays of the game. Specifically, FIG. 4 illustrates Table A 400 and Table B 450. In the illustrated embodiment, Table A 400 includes a symbol column 410 and a number column 420. Table B 450 includes a symbol column 460 and a number column 470. In the illustrated embodiment, each table 400 and 450 includes twenty symbols. Specifically, Table A 400 includes one Ace symbol 410*a*, sixteen King symbols 410*b*, one Queen symbol 410*c*, one Jack symbol 410*d*, and one Ten symbol 410*e*. Table B 450 includes four Ace symbols 460*a*, four King symbols 460*b*, four Queen symbols 460*c*, four Jack symbols 460*d*, and four Ten symbols 460*e*.

In the illustrated embodiment, for a generation of a symbol for an independent reel, the gaming system selects one of the symbols from either Table A 400 or Table B 450 by randomly selecting one of the numbers of the number column 420 or 470, respectively, and displaying the symbol associated with the selected number. In this embodiment, the gaming system has an equal probability of selecting each of the numbers one through twenty of number columns 420 and 470. It should therefore be appreciated that the symbols in symbol columns 410 and 460 define probabilities of selecting each symbol for a spin of a reel associated with either Table A 400 or Table B 450. Specifically, since sixteen of the twenty symbols of Table A 400 are King symbols 410*b*, a random selection of one of the numbers of the number column 420 results in an 80% chance of generating a King symbol. A spin of an independent reel associated with Table A 400 has a 5% chance of generating each of an Ace symbol 410*a*, a Queen Symbol 410*c*, a Jack symbol 410*d*, and a Ten Symbol 410*e* (i.e., each symbol is included once out of twenty total symbols). Since each symbol of Table B 450 is repeated four times, the probability of generating an Ace symbol 460*a*, a King symbol 460*b*, a Queen symbol 460*c*, a Jack symbol 460*d*, and a Ten symbol 460*e* is each 20%. It should therefore be appreciated that Table A 400 represents a weighted table with respect to the King symbol, and that Table B 450 represents a non-weighted table.

In one embodiment, each of the independent reels of the disclosed gaming system includes a virtual reel strip associated with one of the tables 400 or 450. In this embodiment, the order of symbols of the tables 400 or 450 define the order of symbols of the virtual reel strip. Thus, in the illustrated embodiment, a virtual reel strip associated with Table A 400 includes fifteen King symbols in adjacent symbol positions of the virtual reel strip. In this embodiment, displaying a plurality of symbols sequentially according to the order of symbols of the reel strips is relatively likely to result in a plurality of the King symbols being displayed sequentially for the independent reel associated with Table A 400. In various embodiments, the quantity of adjacent designated symbols (such as King symbols) is less than fifteen designated symbols, such as approximately five designated symbols.

FIG. 5 illustrates a schematic representation 500 of a plurality of independent reels, each independent reel being associated with a table usable to generate symbols. Specifically, FIG. 5 illustrates fifteen independent reels arranged as a plurality of columns and a plurality of rows of independent reels. Each of the independent reels illustrated in FIG. 5 is configured to generate and display one of a plurality of symbols based on a probability associated with the symbols for a spin of that independent reel. Each of the independent reels illustrated in schematic representation 500 is also associated with and utilizes either Table A 400 or Table B 450 to generate symbols for plays of the game disclosed herein. Independent reels 502*a*, 502*b*, 502*c*, 502*d*, 502*e*, 502*f*, and 502*g* each use Table A 400 to generate symbols. The remaining independent reels use Table B 450 to generate symbols.

In the illustrated schematic representation 500, any independent reel which uses Table A 400 to generate symbols for spins of that independent reel is weighted with respect to the King symbol 410*b*. It should be appreciated that in the schematic representation 500 of FIG. 5, a plurality of adjacently positioned independent reels are associated with Table A, thus resulting in a stacked symbol effect with respect to the King symbol 410*b* for a plurality of different portions of the matrix of independent reels. Specifically, independent reels 502*a*, 502*c*, and 502*f* are positioned vertically adjacently to one another, and thus provide a vertically-oriented stacked symbol effect for an initial generation of symbols. Similarly, independent reels 502*c*, 502*d*, and 502*e* are positioned horizontally adjacently to one another, and thus provide a horizontally-oriented stacked symbol effect for an initial generation of symbols. Independent reels 502*b* and 502*e* are positioned vertically adjacently to one another, and provide a vertically-oriented stacked symbol effect for an initial generation of symbols. It should be appreciated that independent reel 502*g*, which utilizes Table A 400, is not positioned adjacently to another independent reel which utilizes weighted Table A 400. Thus, in one embodiment the gaming system does not provide a stacked symbol effect with respect to independent reel 502*g*.

In one embodiment, each of the independent reels 502*a*, 502*b*, 502*c*, 502*d*, 502*e*, 502*f*, and 502*g* provides a stacked symbol effect with respect to subsequent generations of symbols during the play of the game. In this embodiment, the gaming system is configured to determine one or more independent reels for a play of the game in which to regenerate a symbol. The gaming system regenerates such symbols by displaying a symbol from a symbol position of a virtual reel strip which is adjacent to the symbol position of the displayed symbol. Thus, it should be appreciated that if one of the designated symbols from the stack of designated symbols is initially displayed, the gaming system is relatively likely to display another one of the stacked symbols for the re-generation. When implemented as a cascading symbols game with respect to the individual independent reels, it should be appreciated that each of the independent reels 502*a*, 502*b*, 502*c*, 502*d*, 502*e*, 502*f*, and 502*g* provides a stacked symbol effect.

FIGS. 6A to 6E are front elevation views of a gaming device 10*a* for providing a game including a plurality of independent reels based on a plurality of tables of symbols such that a stacked symbol effect is provided. In one embodiment each of the plurality of independent reels is also associated with a virtual reel strip, such that the plurality of designated symbols (i.e., King symbols of this example) are positioned in adjacent symbol positions of the virtual reel strips.

Specifically, FIGS. 6A to 6E illustrate a gaming device 10*a* including a plurality of independent reels 602*a*, 602*b*, 602*c*, 602*d*, 602*e*, 602*f*, 602*g*, 602*h*, 602*i*, 602*j*, 602*k*, 602*l*, 602*m*, 602*n*, and 602*o* at various points in time during a play of a game. In the illustrated embodiment, the gaming system spins each independent reel by selecting one of the symbols from the associated table of symbols based on an output of a random number generator. Each table includes Ace symbols, King symbols, Queen symbols, Jack symbols, and Ten symbols. Moreover, each symbol of each table is associated with a probability of generating each that symbol, such that generations by the gaming system are performed in accordance with the appropriate probabilities. It should be appreciated that in various embodiments, one or more independent reels does not include one or more symbols (i.e., one or more reel strips does not include each symbol displayable by each independent reel).

The gaming device of the embodiment illustrated in FIGS. 6A to 6E includes a plurality of independent reels based on the tables illustrated in FIG. 5, such that certain of the independent reels are associated with a reel strip which is weighted with respect to the King symbol. Specifically, independent reels 602*a*, 602*c*, 602*f*, 602*g*, 602*h*, 602*k*, and 602*n* are each associated with Table A 400 of FIG. 4, and the remaining independent reels are associated with Table B 450 of FIG. 4. The illustrated embodiment is therefore configured to provide a stacked symbol effect for an initial generation of symbols with respect to the King symbol for certain sets of adjacent independent reels, as discussed above with respect to FIG. 5. Thus, independent reels associated with Table A 400 generate symbols in accordance with an 80% chance of generating a King symbol and a 5% chance of generating an Ace symbol, a Queen symbol, a Jack symbol, or a Ten symbol. Independent reels associated with Table B 450 generate symbols in accordance with a 20% chance of generating any of an Ace symbol, a King symbol, a Queen symbol, a Jack symbol, or a Ten symbol.

Figure 6A:
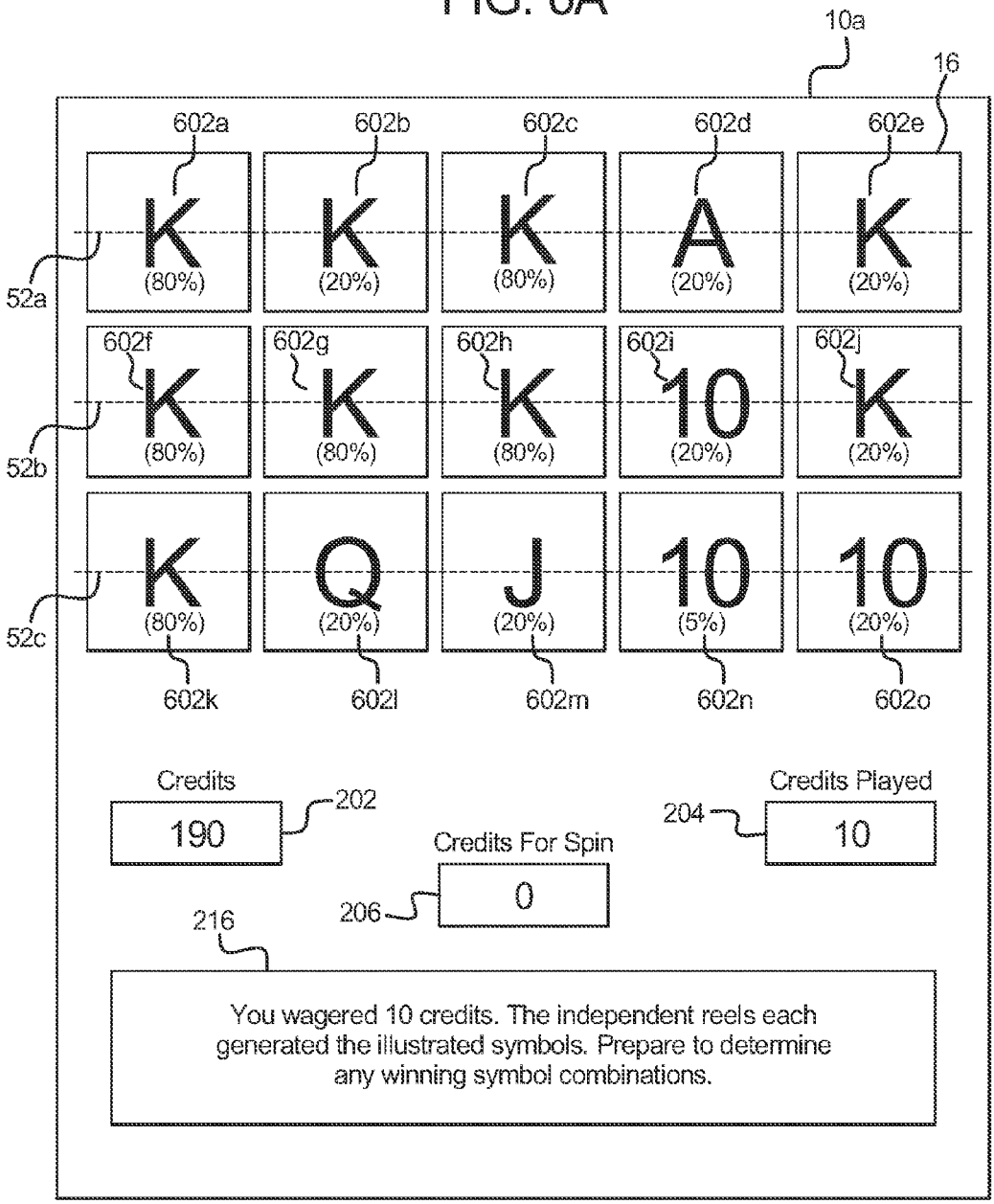
FIGS. 6A, 6B, 6C, 6D, and 6E are front elevation views of a gaming device which implements an independent reel game providing a stacked symbol effect with respect to one of the symbols.

FIGS. 6A to 6E each illustrate a plurality of symbols generated by the plurality of independent reels as well as the probabilities of generating those symbols for the spins of the independent reels, displayed within a set of parentheses. It should be appreciated that these percentages are displayed for illustrative purposes only. In one embodiment, the gaming system generates symbols according to the illustrated probabilities but does not display these probabilities to the player, FIG. 6A illustrates the disclosed gaming device 10*a* at a point in time after the player has wagered on a play of the game and after the gaming device has spun each of the independent reels to generate a plurality of symbols. The illustrated embodiment indicates, in credits display area 202, that the player has one-hundred-ninety credits remaining to wager on plays of the game. Further, the credits played display area 202 indicates that the player wagered ten credits on the current play of the game. Thus, it should be appreciated that the player began wagering with a total of two-hundred credits. Game information display area 210 indicates that the independent reels generated the illustrated symbols.

Figure 6B:
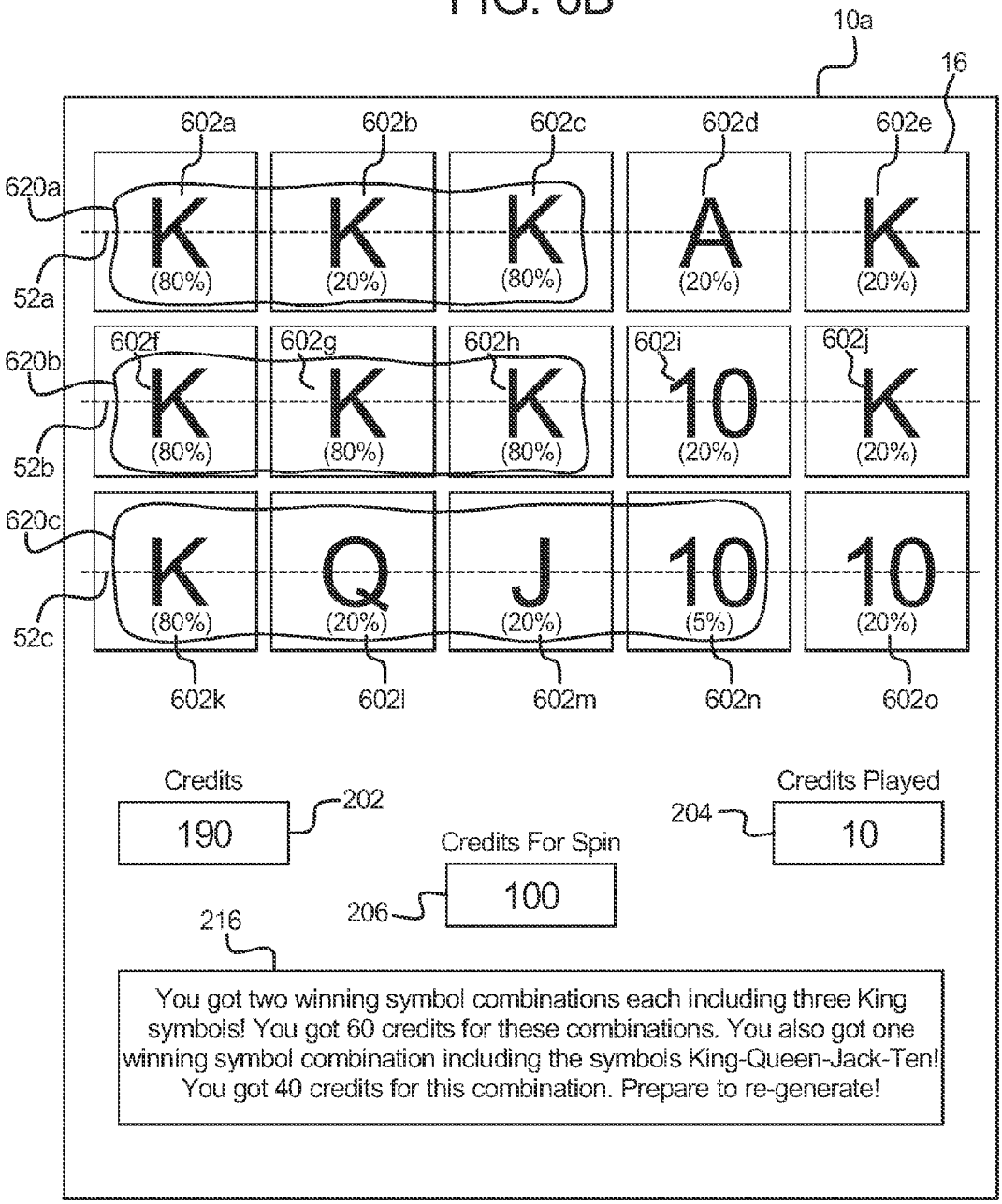

At the point in time illustrated by FIG. 6B, the gaming system has analyzed the symbols displayed by the plurality of independent reels and has determined any resulting winning symbol combinations. Specifically, the gaming device 10*a* has identified winning symbol combinations 610*a*, 610*b*, and 610*c* for the displayed spin of the independent reels. Winning symbol combination 610*a* includes three King symbols, two of which were generated by independent reels utilizing weighted Table A 400. Winning symbol combination 610*b* includes three King symbols, each of which was generated by independent reels utilizing weighted Table A 400. Winning symbol combination 610*c* includes a King symbol generated by independent reel 602*k*, a Queen symbol generated by independent reel 602*l*, a Jack symbol generated by independent reel 602*m*, and a Ten symbol generated by independent reel 602*m*. It should be appreciated that the winning symbol combination 610*c* includes one King symbol generated based on a weighted table, and includes a Ten symbol which was generated based on a weighted table which but is not the symbol toward which the table was weighted. Thus, it should be appreciated that the indicated 5% probability of generating the Ten symbol is relatively low in comparison with the probability of generating the other symbols of winning symbol combination 610*c*. Game information display area 210 of FIG. 6B indicates that the winning symbol combinations 610*a* and 610*b* resulted in awards of thirty credits each, for a total award of sixty credits. Further, the game information display area 210 indicates that the winning combination 610*c* resulted in an award of forty credits. Thus, the total award won up to the point in time illustrated in FIG. 6B is one-hundred credits, which is reflected in the credits for spin display area 606. The game information display area 210 indicates that one or more symbols will be re-generated for one or more of the independent reel(s).

It should be appreciated that winning symbol combination 610*b* was generated and displayed for a plurality of independent reels providing a stacked symbol effect with respect to the King symbol. Specifically, winning symbol combination 610*b* includes three King symbols, each of which was generated by an independent reel which has an 80% chance of generating a King symbol. It should thus be appreciated that by providing the plurality of weighted independent reels, the disclosed gaming system advantageously provides a stacked symbol effect with respect to the King symbol, resulting in a relatively high probability of generating winning symbol combinations, such as winning symbol combination 610*b*, for an initial generation of symbols during a play of the game.

Figure 6C:
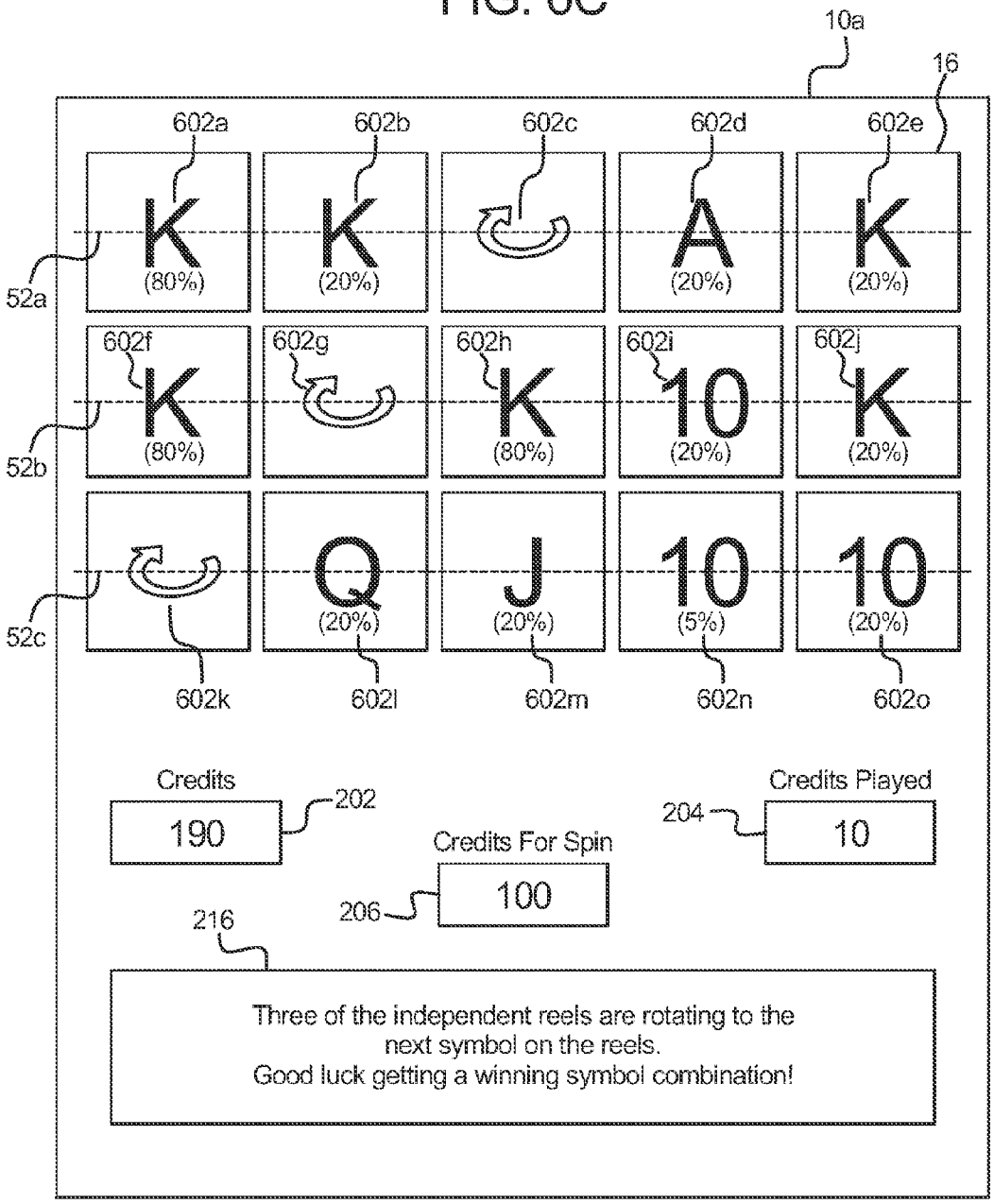
Figure 6D:
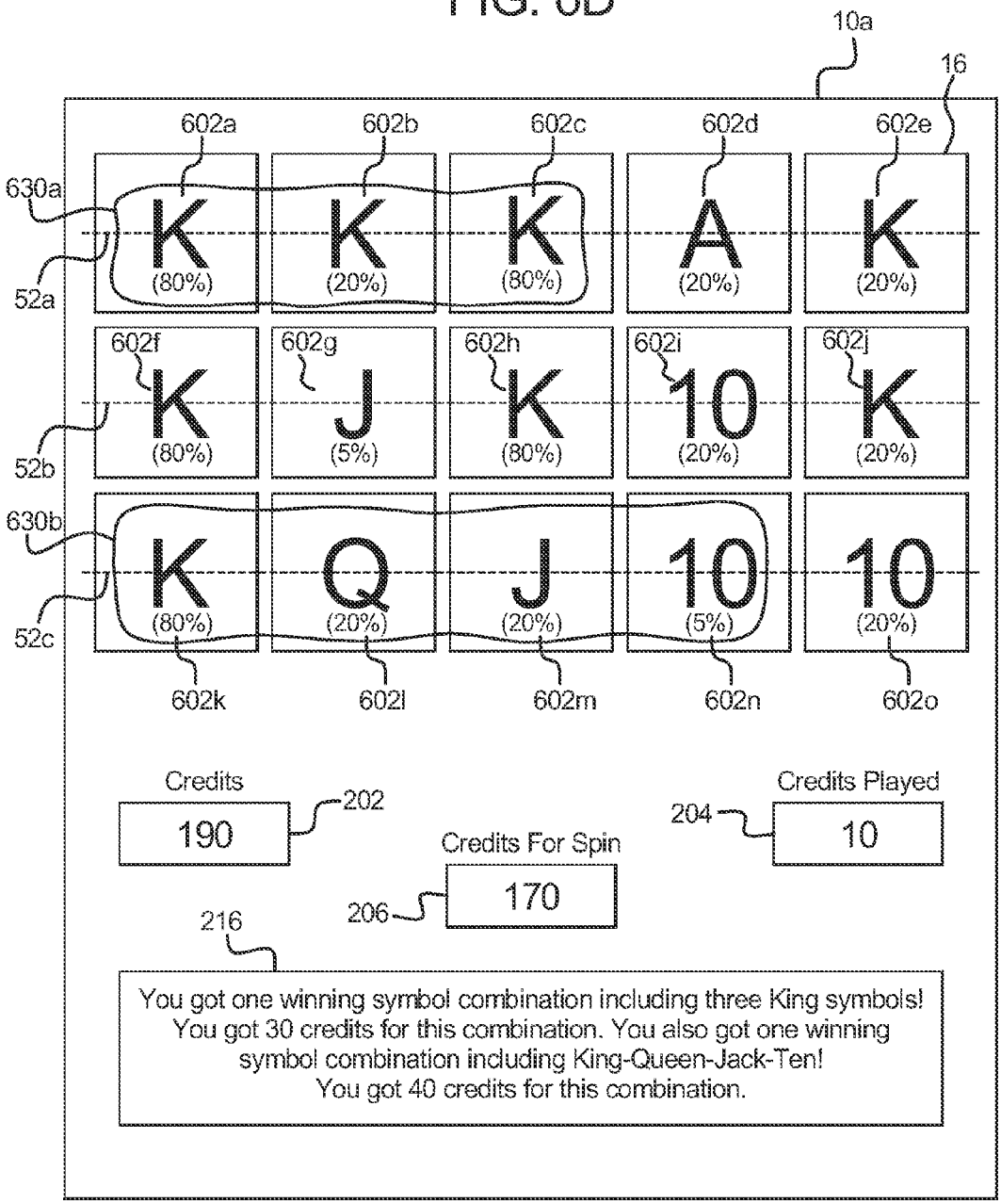

FIG. 6C illustrates a point in time at which a plurality of independent reels are spinning to re-generate symbols for the plurality of independent reels. In the illustrated embodiment, the gaming device 10*a* re-generates a symbol using the independent reels 602*c*, 602*g*, and 602*k*. Game information display area 210 of FIG. 6C indicates that the gaming device 10*a* is re-generating symbols for independent reels which provide the stacked symbol effect with respect to the King symbol. In the illustrated embodiment, the gaming system re-generates symbols by randomly determining one of the symbols of the appropriate independent reel.

It should be appreciated that in the illustrated embodiment, each of the independent reels which re-generates a symbol is an independent reel which utilizes weighted Table A 400. It should be further appreciated that since each independent reel which is being re-spun is associated with weighted Table A 400, the gaming device 10*a* provides the player with a relatively high probability of re-generating a King symbol for the additional spins of the independent reels. In another embodiment, the gaming device re-spins one or more independent reels which do not utilize weighted tables, such as independent reels associated with Table B 450.

In other embodiments, such as the embodiment discussed above with respect to FIG. 3, the gaming system re-generates one or more symbols by displaying a symbol in a symbol position which is adjacent to the symbol position of the currently displayed symbol of a virtual reel strip. It should be appreciated that by displaying an adjacent symbol of a virtual reel strip, the disclosed gaming system advantageously enables a plurality of stacked symbols to be sequentially displayed for a play of the game, thus increasing the probability of generating a plurality of winning symbol combinations for a single play of the game.

It should be appreciated that by re-generating symbols adjacent to previously displayed symbols on the virtual reel strips associated with the disclosed stacked independent reels, the disclosed gaming system provides players with additional opportunities to win awards for winning symbol combinations generated during the play of a game without removing valuable symbols (such as designated symbols for which a stacked symbol effect is provided) from the viewable area of the game. Specifically, in traditional stacked symbol games, a shifting or re-generating feature would frequently result in one or more of the plurality of stacked symbols being shifted out of the viewable area of the disclosed game. By re-generating one or more symbols using the independent reels as disclosed herein (and continuing to display other previously-generated symbols), the disclosed system provides a cascading or tumbling symbols game while maintaining the benefits of the stacked symbol effect of implemented by the independent reels.

FIG. 60 illustrates the gaming device 10*a* at a point in time after the gaming device 10*a* has re-generated a symbol for each independent reel 602*c*, 602*g*, and 602*k* based on the associated independent reels. Specifically, FIG. 6D indicates that another King symbol has been generated by independent reel 602*c* (based on a probability of 80%), a Jack symbol has been generated by independent reel 602*g* (based on a probability of 5%), and another King symbol has been generated by independent reel 602*k* (based on a probability of 80%). The re-generated symbols result in new winning symbol combinations 630*a* and 630*b*. Game information display area 210 indicates that winning symbol combination 630*a* (including three King symbols) is associated with an award of thirty credits and that winning symbol combination 630*b* (including a King symbol, a Queen symbol, a Jack symbol, and Ten symbol) is associated with an award of forty credits. For the re-generation illustrated in FIGS. 6C and 6D, the gaming device 10*a* therefore provides the player with an award of seventy additional credits. The credits for spin display area 606 thus indicates a total award of one-hundred-seventy credits for the play of the game.

It should be appreciated that since each of the independent reels 602*c*, 602*g*, and 602*k* utilizes weighted Table A 400, the gaming device 10*a* is relatively likely to re-generate at least one King symbol. Moreover, it should be appreciated that the gaming device 10*a* is relatively unlikely to generate the Jack symbol by spinning independent reel 602*g*. It should be therefore appreciated that symbols are re-generated using weighted independent reels 602*c*, 602*g*, and 602*k* in accordance with a relatively high probability of re-generating at least one additional winning symbol combination for the play of the game.

Figure 6E:
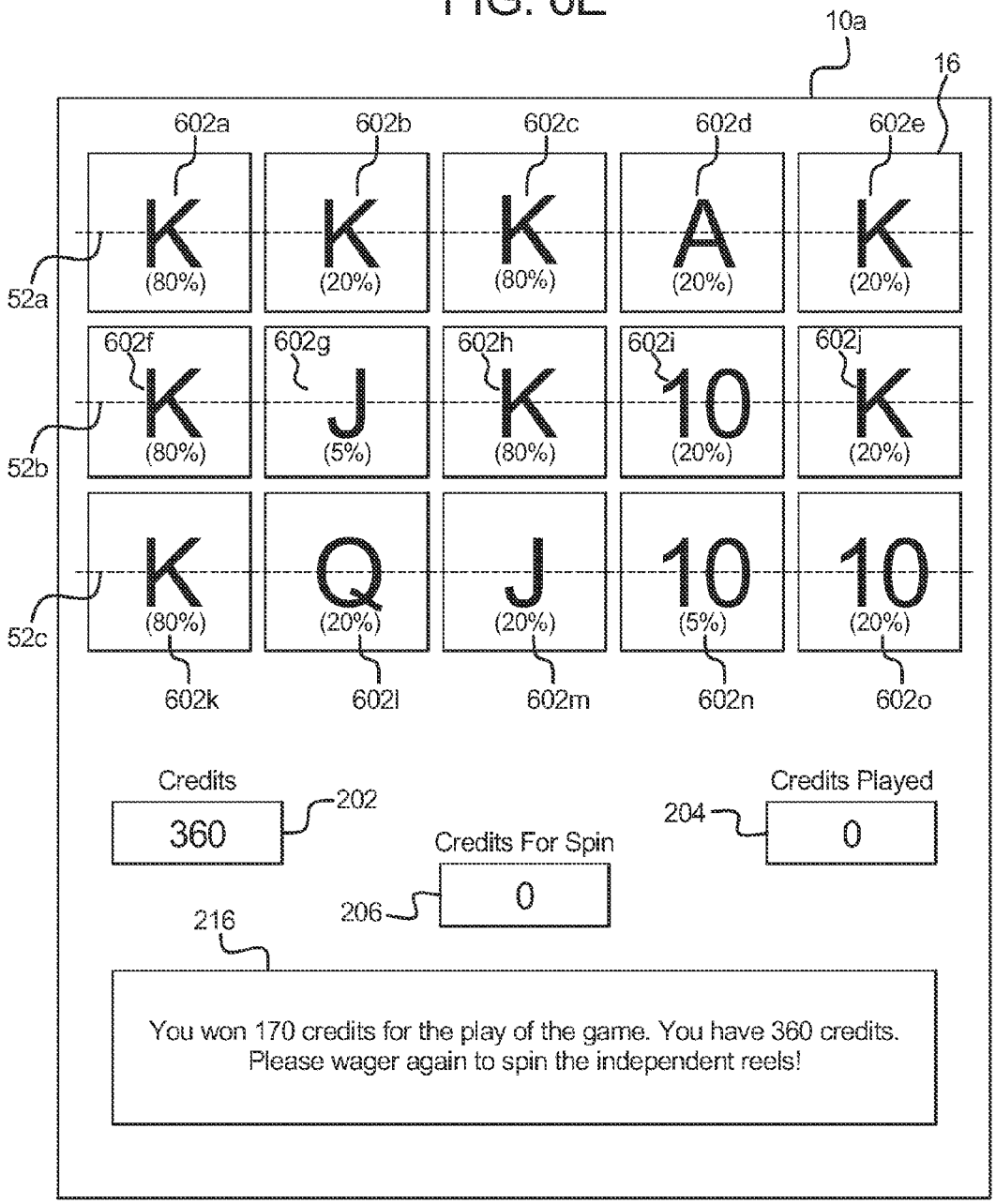

FIG. 6E illustrates a point in time after the gaming device 10*a* has generated any appropriate symbols for the play of the game of FIGS. 6A to 6D. Specifically, game information display area indicates that a total award of one-hundred-seventy credits was provided to the player for the play of the game. The credits display area and the game information display area each indicate that the player has a total of three-hundred-sixty credits to wager on subsequent plays of the game.

In the embodiment illustrated in FIGS. 6A to 6E, the gaming device 10*a* only performs a single set of re-generations. In another embodiment, the gaming system does not re-generate any symbols for any of the plurality of independent reels. In various embodiments, the quantity of re-generations performed for a play of the game is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In the embodiment illustrated in FIGS. 6A to 6E, the gaming device 10*a* only re-spins the independent reels which utilize the weighted Table A 400. In one embodiment, the gaming system is configured to determine one or more independent reels to re-spin which are not associated with weighted Table A 400. In various embodiments, which of any independent reels are selected for re-generation is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

Figure 7:
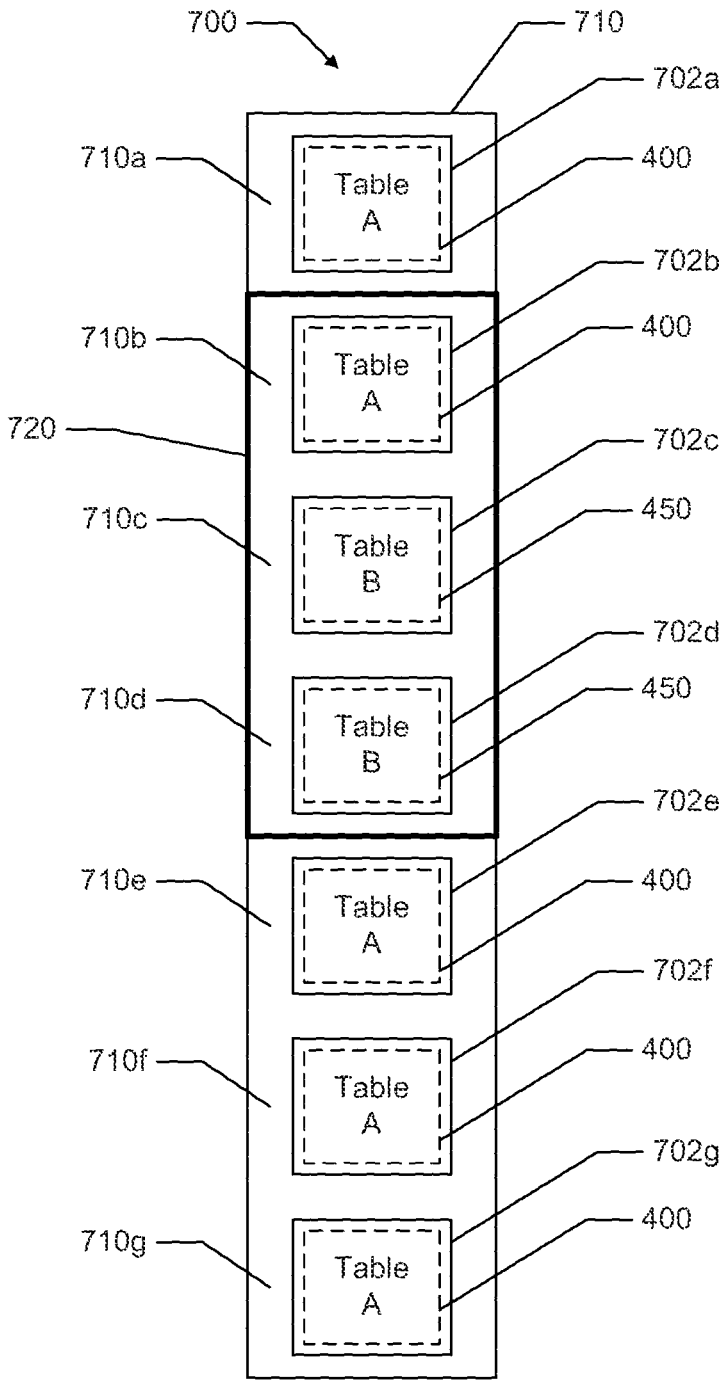
FIG. 7 is a schematic representation of an outer reel strip which includes a plurality of inner independent reel strips in the symbol positions of the outer reel strip.

FIG. 7 illustrates a schematic representation 700 of a dependent reel which includes a plurality of independent reels in a plurality of symbol positions of the dependent reel. In the illustrated embodiment, each of the independent reels utilizes one of a plurality of tables to display symbols for generations by that independent reel. Specifically, dependent reel 710 includes a plurality of symbol positions 710*a*, 710*b*, 710*c*, 710*d*, 710*e*, 710*f*, and 710*g*. In this embodiment, each symbol position is associated with an independent reel which is configured to generate symbols utilizing a virtual reel strip and an associated table. In the illustrated embodiment, each of the tables by dependent reel 710 is one of either Table A 400 or Table B 450 illustrated in FIG. 4. Specifically, symbol position 710*a* is associated with independent reel 702*a* which utilizes Table A 400, symbol position 710*b* is associated with independent reel 702*b* which utilizes Table A 400, symbol position 710*c* is associated with independent reel 702*c* which utilizes Table B 450, symbol position 710*d* is associated with independent reel 702*d* which utilizes Table B 450, symbol position 710*e* is associated with independent reel 702*e* which utilizes Table A 400, symbol position 710*f* is associated with independent reel 702*f* which utilizes Table A 400, and symbol position 710*g* is associated with independent reel 702*g* which utilizes Table A 400.

In the illustrated embodiment, the gaming system disclosed herein is configured to utilize the dependent reel 710 to determine which of a plurality of independent reels to use to generate symbols for a play of a game having a matrix of independent reels. In one embodiment, the matrix of independent reels includes five columns or windows of independent reels, each column or window including three independent reels. In the illustrated embodiment, the gaming system spins dependent reel 710 to determine which independent reels to use to generate symbols for at least one of the five columns of independent reels. In the illustrated embodiment, the gaming system determines that three adjacent independent reels 702*b*, 702*c*, and 702*d* will be used to generate symbols for one of the columns during a play of the game. This determination is indicated by the independent reels selection indicator 720.

In one embodiment, for a play of the game, the gaming system generates a symbol utilizing each of the independent reels 702*b*, 702*c*, and 702*d* selected by spinning the dependent reel 710. These generations are based on the tables 400 and 450 associated with the independent reels, such that the gaming system is relatively likely to generate a designated symbol for the top independent reel (i.e., independent reel 702*b*). Thus, it should be appreciated that the dependent reel 710 in one embodiment increases player excitement and enjoyment by changing which independent reels (and the tables associated with the independent reels) are utilized to generate symbols for a play of the game.

In one embodiment, during a play of the game, the gaming system re-generates a set of independent reels usable to generate symbols by re-spinning dependent reel 710. In one such embodiment, the gaming system turns or shifts the independent reel 710 by one position upon determining that a winning symbol combination has been displayed, such that a different set of independent reels are utilized to generate symbols for the play of the game. In another embodiment, the gaming system spins dependent reel 710 during the play of the game to newly generate a subset of independent reels usable to generate symbols.

It should be appreciated that in one embodiment, such as the embodiment illustrated in FIG. 7, the plurality of independent reels are stacked on the dependent reel—that is, a plurality of independent reels associated with Table A are positioned adjacent one another on dependent reel 710. In this embodiment, spinning the dependent reel 710 is relatively likely to generate at least one independent reel associated with weighted Table A 400 usable for a play of the game, thus increasing the probability of generating one or more designated symbols. It should be further appreciated that shifting or turning the dependent reel 710 by one position to subsequently alter which of the independent reels are utilized is relatively likely to maintain at least one independent reel in the appropriate column or window of independent reels which is associated with weighted Table A 400. In the illustrated embodiment, utilizing a dependent reel such as dependent reel 710 increases the probability of initially generating a designated symbol for a play of the game and for re-generating the designated symbol during the play of the game, thus increasing the probability of generating a plurality of winning symbol combinations for a single play of the game.

In one embodiment, the dependent reel and the plurality of independent reels contained thereon are implemented as mechanical reels. In this embodiment, the dependent reel is an outer mechanical reel, and each symbol position of the outer mechanical reel includes an inner mechanical independent reel. For the play of the game, the gaming system spins the outer mechanical reel to generate a subset of the inner independent reels, and spins each of the subset of independent reels to generate symbols usable to determine awards.

In one embodiment, the gaming system displays the spinning of the dependent reel to the player. In another embodiment, the gaming system selects a plurality of independent reels from the symbol positions of the dependent reel without displaying the selection to the player. In one embodiment, the gaming system displays an indicator corresponding to which of the independent reels is being used to generate symbols for the play of the game. For example, the gaming system displays a green ring around any independent reel utilizing Table A 400 (i.e., the table which is relatively likely to generate the designated symbol) and a red ring around any independent reel utilizing Table B 450 (i.e., the table which is not weighted toward generating the designated symbol). Moreover, in one embodiment the gaming system indicates the shifting or rotating of the dependent reel 710 such that when a portion of a stack of independent reels is displayed, the player is aware that the currently displayed independent reels are relatively likely to generate designated symbols (and thus additional winning symbol combinations). It should be appreciated that indicating which of the independent reels is being utilized to generate symbols for a play of the game increases player excitement and enjoyment by magnifying the stacked symbol effect with respect to the designated symbol for a play of the game.

In one embodiment, the gaming system disclosed herein is configured to assign the plurality of reel strips and tables to the plurality of independent reels prior to a player wagering on a play of the game. In this embodiment, the disclosed gaming system provides a same stacked symbol effect for a plurality of plays of the game for a plurality of different players. In another embodiment, the gaming system assigns the reel strips and tables to the independent reels after the player has wagered on a play of the game. In one such embodiment, the gaming system assigns at least one table to at least one reel based on the player's wager on the play of the game. In various embodiments, which reel strips are assigned to which independent reels is predetermined, randomly determined, determined based on a generated symbol or symbol combination, determined based on a random determination by the central controller, determined based on a random determination at the gaming system, determined based on one or more side wagers placed, determined based on time (such as the time of day), determined based on an amount of coin-in accumulated in one or more pools or determined based on any other suitable method or criteria. In one embodiment, the gaming system determines a plurality of adjacent weighted independent reels prior to a play of the game and randomly determines which of a plurality of weighted tables to assign to the remainder of the reels. It should be appreciated that any suitable mechanism of determining which tables to assign to which reel is contemplated herein.

In one embodiment, the gaming system selects an independent reel with which to re-generate a symbol for a play of the game based on the winning symbol combinations generated, such as by re-generating a symbol for each independent reel which displays a symbol included in a winning symbol combination. In other embodiments, which independent reel is selected to re-generate a symbol is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, each table utilized by the independent reels of the disclosed gaming system includes the same plurality of symbols. In another embodiment, at least one table includes at least one symbol which is not included on at least one different table. It should be appreciated that in this embodiment, certain of the independent reels associated with certain of the tables are incapable of generating certain symbols for the play of the game. In one embodiment, each independent reel is associated with a table which includes the designated symbol (i.e., a symbol for which a stacked symbol effect is provided) based on a non-zero probability.

In one embodiment, wherein each independent reel utilizes a reel strip including the same set of symbols, the disclosed gaming system is configured to shift at least one previously displayed symbol such that a different independent reel displays the shifted symbol. In various embodiments, the gaming system shifts a symbol by displaying the symbol using a shifted-to independent reel. In one embodiment, the gaming system shifts the symbol from an adjacent independent reel to the different independent reel. In a further embodiment, the gaming system shifts a symbol from an independent reel which utilizes a weighted reel strip to generate symbols to a different independent reel which does not utilize a weighted reel strip. In various embodiments, which symbol to shift to a different independent reel is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming system disclosed herein is programmed to randomly re-generate a symbol for an independent reel as opposed to displaying a symbol in an adjacent symbol position to the currently displayed symbol. In this embodiment, for any determined independent reel during a play of the game, the gaming system randomly generates a symbol using the associated reel strip and displays the generated symbol to the player. In various embodiments, whether to randomly generate a symbol for a determined independent reel is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming system alters the table utilized by a determined one of the independent reels prior to re-generating a symbol for that independent reel. In one such embodiment, the gaming system randomly selects one of a plurality of tables and associates the selected table with an independent reel determined to re-generate a symbol prior re-generating a symbol for that independent reel. In another embodiment, the gaming system shifts the table associated with an adjacent independent reel to the determined independent reel prior to spinning the independent reel. In various embodiments, the reel strip with which the gaming system associates the determined independent reel is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming system disclosed herein is configured to provide at least two adjacent independent reels associated with weighted reel strips for generating a designated symbol, thus causing a stacking effect with respect to the designated symbol. In one embodiment, the designated symbol is a wild symbol, usable as any symbol for purposes of determining winning symbol combinations. In another embodiment, the designated symbol is a symbol usable to form designated winning symbol combinations, such as winning symbol combinations associated with high-value awards. In various embodiments, the gaining system is programmed to adjacently position independent reels associated with reel strips weighted for other symbols, such as symbols which are randomly determined for a play of the game. In various embodiments, which symbols are stacked is predetermined, randomly determined, determined based on a generated symbol or symbol combination, determined based on a random determination by the central controller, determined based on a random determination at the gaming system, determined based on one or more side wagers placed, determined based on the player's primary game wager, determined based on time (such as the time of day), determined based on an amount of coin-in accumulated in one or more pools or determined based on any other suitable method or criteria.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of operating a gaming system, for a single play of a game, said method comprising:

(a) enabling a player to wager on the play of the game, (b) causing at least one display device to display a plurality of independent reels, each independent reel including a plurality of symbols in a plurality of symbol positions, each of the symbols having a probability of being generated, wherein at least two vertically adjacent independent reels are each stacked with a designated symbol, (c) causing at least one processor to execute a plurality of instructions to generate one of the symbols in one of the symbol positions of each of the plurality of independent reels in accordance with the probability of being generated for each symbol, (d) causing the at least one display device to display the generated symbols, and (e) when any winning symbol combination is displayed:

(i) causing the at least one display device to display an award based on each winning symbol combination, (ii) for at least one independent reel of at least one winning symbol combination, for said at least one independent reel:

(A) causing the at least one processor to execute the plurality of instructions to generate a symbol in an adjacent symbol position to the symbol position of the displayed symbol of said at least one independent reel, and (B) causing the at least one display device to display the generated symbol in the adjacent symbol position to the symbol position of the displayed symbol of said at least one independent reel, and (iii) repeating (e) at least once.

2. The method of claim 1, which includes, for the play of the game, causing the at least one processor to execute the plurality of instructions to randomly associate one of a plurality of reel strips with each of the plurality of independent reels.

3. The method of claim 1, which includes, when any winning symbol combination is displayed for the plurality of independent reels, causing the at least one processor to execute the plurality of instructions to alter the probability of being generated of the designated symbol associated with at least one of the plurality of independent reels.

4. The method of claim 1, wherein the probability of being generated for the designated symbol of each of the at least two vertically adjacent stacked independent reels is greater than the probability of being generated for any other symbol of each of said two vertically adjacent stacked independent reels.

5. The method of claim 1, wherein a first probability of being generated for the designated symbol is associated with a first independent reel, and which includes, when any winning symbol combination is displayed for the plurality of independent reels, causing the at least one processor to execute the plurality of instructions to associate said first probability with a second independent reel, the second independent reel being adjacent to the first independent reel.

6. The method of claim 5, wherein the symbol displayed by the second independent reel is included in at least one winning symbol combination.

7. The method of claim 1, wherein the at least two vertically adjacent stacked independent reels form a first set of stacked independent reels, and which includes causing the at least one display device to display a second set of stacked independent reels as horizontally adjacent to the first set of stacked independent reels, the second set of stacked independent reels including at least two vertically adjacent stacked independent reels.

8. The method of claim 1, which includes, when any winning symbol combination is displayed for the plurality of independent reels, causing the at least one processor to execute the plurality of instructions to shift a first symbol displayed by a first independent reel to a second independent reel such that the second independent reel displays the first symbol, the first independent reel being adjacent to the second independent reel.

9. The method of claim 8, wherein the symbol displayed by the second independent reel is included in at least one winning symbol combination.

10. The method of claim 1, wherein at least one of the wager on the play of the game and any displayed award is selected from the group consisting of: a quantity of monetary credits and a quantity of non-monetary credits.

11. The method of claim 1, which is provided through a data network.

12. The method of claim 11, wherein the data network is an internet.

13. The method of claim 1, wherein any awards cause an increase of a credit balance which is increasable via an acceptor of a physical item associated with a monetary value, and decreasable via a cashout device configured to receive an input to cause an initiation of a payout associated with the credit balance.

14. The method of claim 1, which includes, when any winning symbol combination is displayed, for said at least one independent reel of the at least one winning symbol combination, causing the at least one processor to execute the plurality of instructions to randomly generate the symbol in the adjacent symbol position to the symbol position of the displayed symbol of said at least one independent reel.

15. A method of operating a gaming system, said method comprising:

(a) causing at least one display device to display a plurality of dependent reels, each of the dependent reels including a plurality of dependent reel symbol positions, each of the dependent reel symbol positions being associated with an independent reel, each independent reel including a reel strip having a plurality of symbols in a plurality of independent reel symbol positions, wherein at least one of the independent reels is stacked with a designated symbol, (b) enabling a player to wager on a single play of a game, and (c) for the single play of the game:

(i) causing at least one processor to execute a plurality of instructions to select a same quantity of adjacent dependent reel symbol positions for each dependent reel for the play of the game, wherein for each selected dependent reel symbol position:

(A) causing the at least one processor to execute the plurality of instructions to generate one of the symbols of the independent reel which is associated with said dependent reel symbol position, and (B) causing the at least one display device to display said generated symbol in said dependent reel symbol position, and (ii) when any winning symbol combination is displayed:

(A) causing the at least one display device to display an award to the player based on said displayed winning symbol combination, and (B) for a selected symbol displayed in a selected independent reel symbol position of one of the independent reels:

(I) causing the at least one display device to display a different symbol for said selected independent reel symbol position of said independent reel, said different symbol being in an independent reel symbol position adjacent to the selected independent reel symbol position of said independent reel, and (II) repeating (ii) at least once.

16. The method of claim 15, which includes, for the play of the game, causing the at least one processor to execute the plurality of instructions to randomly associate one of the plurality of dependent reels with each column of a matrix of independent reels.

17. The method of claim 15, which includes, when any winning symbol combination is displayed, causing the at least one processor to execute the plurality of instructions to alter a probability of being generated of the designated symbol associated with at least one of the plurality of independent reels.

18. The method of claim 15, wherein a probability of being generated for the designated symbol of each of the at least two vertically adjacent stacked independent reels is greater than a probability of being generated for any other symbol of each of said two vertically adjacent stacked independent reels.

19. The method of claim 15, which includes causing the at least one processor to execute the plurality of instructions to select a same quantity of adjacent dependent reel symbol positions for each dependent reel in the single play of the game by randomly selecting a plurality of adjacent dependent reel symbol positions for each dependent reel.

20. The method of claim 15, which includes causing the at least one processor to execute the plurality of instructions to select a same quantity of adjacent dependent reel symbol positions for at least one dependent reel in the single play of the game by rotating said at least one independent reel by one dependent reel symbol position.

21. The method of claim 15, wherein at least one of the dependent reels is stacked with a set of weighted independent reels, each of the subset of weighted independent reels being stacked with a designated symbol.

22. The method of claim 21, wherein at least two adjacent dependent reels are each stacked with a set of weighted independent reels.

23. The method of claim 15, which includes, when any winning symbol combination is displayed, causing the at least one processor to execute the plurality of instructions to select a different quantity of adjacent dependent reel symbol positions for at least one of the dependent reels.

24. The method of claim 15, wherein the selected symbol is one of a plurality of symbols of one of the winning symbol combinations.

25. The method of claim 24, wherein each symbol of any of the winning symbol combinations is the selected symbol, and which includes, for each of the plurality of selected symbols, causing the at least one display device to display a different symbol for said selected independent reel symbol position, said different symbol being in an independent reel symbol position adjacent to the selected independent reel symbol position.

26. The method of claim 15, wherein at least one of the wager on the single play of the game and any displayed award is selected from the group consisting of: a quantity of monetary credits and a quantity of non-monetary credits.

27. The method of claim 15, which is provided through a data network.

28. The method of claim 27, wherein the data network is an internet.

29. The method of claim 15, wherein any awards cause an increase of a credit balance which is increasable via an acceptor of a physical item associated with a monetary value, and decreasable via a cashout device configured to receive an input to cause an initiation of a payout associated with the credit balance.

30. The method of claim 15, which includes, when any winning symbol combination is displayed, for the selected symbol displayed in the selected independent reel symbol position of one of the independent reels, causing the at least one display device to display a random different symbol for said selected independent reel symbol position of said independent reel, said random different symbol being in the independent reel symbol position adjacent to the selected independent reel symbol position of said independent reel.

* * * * *